US009991582B2

(12) United States Patent
Ochi et al.

(10) Patent No.: US 9,991,582 B2
(45) Date of Patent: Jun. 5, 2018

(54) GLASS ANTENNA FOR VEHICLE AND REAR WINDOW GLASS INCLUDING GLASS ANTENNA FOR VEHICLE

(71) Applicant: Asahi Glass Company, Limited, Chiyoda-ku (JP)

(72) Inventors: Tatsuya Ochi, Chiyoda-ku (JP); Yuki Kishimoto, Chiyoda-ku (JP); Tomohiro Takahashi, Chiyoda-ku (JP)

(73) Assignee: Asahi Glass Company, Limited, Chiyoda-ku (JP)

( * ) Notice: Subject to any disclaimer, the term of this patent is extended or adjusted under 35 U.S.C. 154(b) by 64 days.

(21) Appl. No.: 15/284,729

(22) Filed: Oct. 4, 2016

(65) Prior Publication Data

US 2017/0125877 A1 May 4, 2017

(30) Foreign Application Priority Data

Oct. 30, 2015 (JP) ..... 2015-215221
May 23, 2016 (JP) ..... 2016-102841

(51) Int. Cl.

| | |
|---|---|
| ***H01Q 1/32*** | (2006.01) |
| ***H01Q 9/42*** | (2006.01) |
| ***H01Q 1/12*** | (2006.01) |
| ***H01Q 21/30*** | (2006.01) |

(52) U.S. Cl.

CPC ..... *H01Q 1/1285* (2013.01); *H01Q 1/1271* (2013.01); *H01Q 1/3275* (2013.01); *H01Q 9/42* (2013.01); *H01Q 21/30* (2013.01)

(58) Field of Classification Search

CPC ..... H01Q 1/1271; H01Q 21/30; H01Q 9/42
USPC ..... 343/713
See application file for complete search history.

(56) References Cited

U.S. PATENT DOCUMENTS

2008/0158073 A1* 7/2008 Ibe ..... H01Q 1/1271 343/713

FOREIGN PATENT DOCUMENTS

| | | |
|---|---|---|
| JP | 5024026 | 9/2012 |
| JP | 2015-99949 | 5/2015 |

* cited by examiner

*Primary Examiner* — Dameon E Levi
*Assistant Examiner* — Ricardo Magallanes
(74) *Attorney, Agent, or Firm* — Oblon, McClelland, Maier & Neustadt, L.L.P.

(57) ABSTRACT

A glass antenna for a vehicle is disposed adjacent to an upper edge portion of a window glass. The glass antenna for receiving two types of frequency bands includes a feed point; a first antenna conductor; and a second antenna conductor. The first antenna conductor includes a vertical element for feed connection; a first transverse element; and a second transverse element. The second antenna conductor includes a transverse element for feed connection; a vertical element for connection; a third transverse element; a fourth transverse element; an upper vertical element; and an upper transverse element. The first transverse element and the third transverse element are capacitively coupled to each other to form a first capacitively-coupled portion. The second transverse element and the fourth transverse element are capacitively coupled to each other to form a second capacitively-coupled portion. The upper transverse element is located above the second capacitively-coupled portion.

16 Claims, 16 Drawing Sheets

GLASS ANTENNA FOR VEHICLE AND REAR WINDOW GLASS INCLUDING GLASS ANTENNA FOR VEHICLE

BACKGROUND OF THE INVENTION

1. Field of the Invention

The disclosures herein generally relate to a glass antenna for a vehicle and a rear window glass including the glass antenna for the vehicle.

2. Description of the Related Art

Because necessary conditions (such as frequency bands, polarized waves, and coexistence media) for a glass antenna for a vehicle mounted on the vehicle differ depending on countries, antenna performance of the glass antenna is adjusted for each region. Japanese Patent No. 5024026 discloses a glass antenna as illustrated in FIG. 1 in order to receive both FM radio and AM radio.

The configuration disclosed in Japanese Patent No. 5024026 has a defogger disposed on a rear window glass 60. The glass antenna, which can receive both a frequency band corresponding to AM and a frequency band corresponding to FM, is disposed, above the defogger 40, on a blank space of the rear window glass 60. In this example, an antenna element 51*a* and an antenna element 52*a* are capacitively coupled, and an antenna element 51*b* and an antenna element 52*b* are capacitively coupled.

In the above described configuration, man-hours for designing and man-hours for managing part numbers (item codes) may increase because design such as adjustment of an antenna length is performed for each community and country such as Japan and Europe, for example.

In order to reduce these man-hours, it is needed to commonalize antenna patterns that constitute glass antennas used in respective countries.

SUMMARY OF THE INVENTION

It is a general object of at least one embodiment of the present disclosure to provide a glass antenna for a vehicle and a rear window glass including the glass antenna for the vehicle that substantially obviate one or more problems caused by the limitations and disadvantages of the related art.

According to one aspect of the present disclosure, a glass antenna for a vehicle receives two types of frequency bands. The glass antenna is disposed adjacent to an upper edge portion of a window glass for the vehicle. The glass antenna includes a feed point; a first antenna conductor; and a second antenna conductor. The first antenna conductor includes: a vertical element for feed connection one end of which is connected to the feed point and extending upwardly from the feed point; a first transverse element one end of which is connected to the feed point or to the vertical element for feed connection and extending substantially horizontally in a direction away from the feed point; and a second transverse element one end of which is connected to the vertical element for feed connection and extending substantially horizontally in the direction away from the feed point, the second transverse element being located above the first transverse element. The second antenna conductor includes: a transverse element for feed connection one end of which is connected to the feed point or to the vertical element for feed connection and extending substantially horizontally in the direction away from the feed point, a vertical element for connection one end of which is connected to the other end of the transverse element for feed connection and extending upwardly; a third transverse element one end of which is connected to the vertical element for connection and extending substantially horizontally in a direction toward the feed point; a fourth transverse element one end of which is connected to the vertical element for connection and extending substantially horizontally in the direction toward the feed point, the fourth transverse element being located above the third transverse element; an upper vertical element one end of which is connected to the fourth transverse element or to the other end of the vertical element for connection and extending upwardly; and an upper transverse element one end of which is connected to the upper vertical element and extending substantially horizontally in the direction toward the feed point. The first transverse element and the third transverse element are adjacent to each other and capacitively coupled to each other to form a first capacitively-coupled portion. The second transverse element and the fourth transverse element are adjacent to each other and capacitively coupled to each other to form a second capacitively-coupled portion. The upper transverse element is located above the second capacitively-coupled portion.

DESCRIPTION OF THE PREFERRED EMBODIMENTS

In the following, embodiments of the present disclosure will be described with reference to the accompanying drawings. An object of the embodiments is to provide a glass antenna for a vehicle that can receive wideband radio and can be used worldwide.

It should be noted that unless specified otherwise, directions in the descriptions below correspond to directions illustrated in drawings. Also, each of these drawings illustrates a window glass as seen from a side facing a glass surface and corresponds to a view from inside a vehicle (or from outside the vehicle) in a state where the window glass is attached to the vehicle. A right-left direction (transverse direction) in each drawing corresponds to a horizontal direction and a vertical direction in each drawing corresponds to a perpendicular direction. However, the view may also be regarded as a view from outside the vehicle.

For example, in a case where the window glass is a rear glass attached to a rear portion of the vehicle, the right-left direction in each drawing corresponds to a width direction of the vehicle. Also, the window glass according to the present invention is mainly a rear glass (rear window glass) attached to the rear portion of the vehicle. Also, in the descriptions below, directional terms such as "parallel" and "perpendicular" are not used in their strict sense and are meant to allow some degree of deviation to the extent the effects of the present invention are not hindered.

Also, in the present invention, the window glass is an example that covers an opening portion of a vehicle body. The window glass is a plate-like member. Materials of the window glass are not limited to glass but may be resin, a film, or the like. A rear window glass 60, which may be referred to as a rear glass or a window glass for a vehicle, is attached to a housing opening portion, which may be referred to as an opening portion, formed by a flange of the vehicle housing.

Here, a vehicle body opening edge of the window means a peripheral edge of the opening portion of the vehicle body to which the window glass (plate) is fitted, which serves as vehicle grounding and is made of a conductive material, such as metal, for example.

<Entire Structure of Window>

Figure 2:
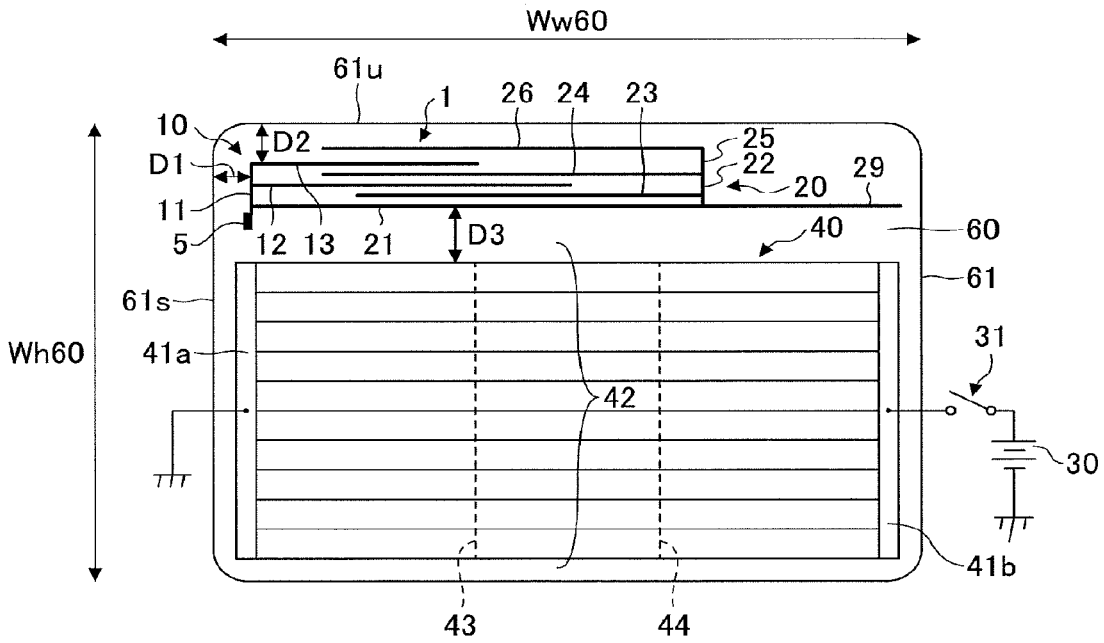
FIG. 2 is an entire plan view of a rear window glass on which a glass antenna is disposed according to a first embodiment of the present invention.

FIG. 2 is an entire plan view of the rear window glass 60 including a glass antenna 1 according to one embodiment of the present invention. Here, the glass antenna may be referred to as a glass antenna for a vehicle or an antenna for a vehicle.

The rear window glass (rear glass) 60 is a window glass including an outer peripheral edge 61 attached to a flange (or a plastic panel) formed on an outside of the vehicle body. A vehicle opening edge (flange) of the vehicle body is a peripheral edge of an opening portion of the vehicle to which the rear window glass is fitted and serves as vehicle grounding. The flange is made of a conductive material such as metal.

In the embodiment of the present invention, the outer peripheral edge of the rear window glass 60 and the inner peripheral edge (opening edge) of the vehicle body side are disposed at the same position. The reference numeral 61 indicates the position. However, the vicinity of the outer peripheral edge of the rear window glass 60 and the flange of the vehicle body side may be overlapped with each other.

In FIG. 2, the glass antenna is configured to have antenna conductors 10 and 20 and a feed point provided on the rear window glass 60 for the vehicle as a planar conductive pattern. For example, the glass antenna may be printed on, embedded in, or attached to the window glass.

An electric heating defogger 40 is disposed on the rear window glass 60 to which the first to tenth embodiments are applied. The defogger 40 includes a plurality of heater strips 42 and a plurality of bus bars 41*a* and 41*b* that feed a current to the heater strips 42.

Specifically, in the example of the defogger 40 illustrated in FIG. 2, the rear window glass 60 has at least one bus bar 41*a* in a band shape and at least one bus bar 41*b* in a band shape disposed in a left-hand region and a right-hand region (both end sides in the left and right direction) thereof, respectively. The bus bars 41*a* and 41*b* are configured to extend (elongate, stretch) in the vertical direction or the substantially vertical direction of the rear window glass 60.

For example, the bus bar 41*a* is connected to vehicle grounding, and the bus bar 41*b* is connected to the anode of a DC power supply 30 via a switch 31.

The plurality of heater strips 42 extend in the horizontal direction or the substantially horizontal direction, broadly in the transverse direction or the substantially transverse direction. For example, it is preferable for general motors in terms of ensuring sight that a lateral width of the defogger 40, that is, a distance (Dw) between the bus bars 41*a* and 41*b* is in a range of from 900 mm to 1200 mm.

In the present invention, there is no limitation to the shape of the defogger. That is, the number of bus bars is not limited to 2. The number of bus bars may be 2 or more than 2. The bus bars do not need to extend in the vertical direction or the substantially vertical direction of the rear window glass 60. For example, the bus bars may extend in the transverse direction or the substantially transverse direction of the rear window glass 60.

Here, the heater strips 42 may be short-circuited by short circuit lines 43 and 44 at portions thereof except for the bus bars 41*a* and 41*b*. Specifically, in the example illustrated in FIG. 2, the two short circuit lines of a first short circuit line 43 and a second short circuit line 44 are disposed as the short circuit lines, and both of the short circuit lines are configured to extend in the vertical direction or the substantially vertical direction of the rear window glass 60.

The first short circuit line 43 is disposed on a left side of the rear window glass 60 with respect to the center of the rear window glass 60 in the left and right direction. The second short circuit line 44 is disposed on a right side of the rear window glass 60 with respect to the center of the rear window glass 60 in the left and right direction. Each of the first short circuit line 43 and the second short circuit line 44 is disposed within a range of 40 mm to 300 mm from the center of the rear window glass 60 in the left and right direction.

As illustrated in FIG. 2, the glass antenna according to the embodiment of the present invention is disposed in a blank space of the rear window glass 60. The blank space is located above the defogger 40. The glass antenna is disposed around (adjacent to) the upper edge portion of the rear window glass 60. In order to improve antenna gain for frequency band L and for frequency band H, it is preferable that the shortest distance between the defogger 40 and the glass antenna 1, that is, a length between the uppermost heater strip 42*u* and a transverse element 21 for feed connection, which will be described later, is in a range of from 20 mm to 100 mm. Here, the distance between the defogger 40 and the glass antenna 1 may be 30 mm or longer.

The glass antenna according to the embodiment of the present invention advantageously receives two types of frequency bands. Specifically, the glass antenna advantageously receives a signal in frequency band L and a signal in frequency band H that is higher than frequency band L. For example, frequency band L (low frequency band) may be an AM broadcast band (530 kHz to 1605 kHz). For example, frequency band H (high frequency band) may be a Japanese FM broadcast band (76 MHz to 95 MHz) and a European FM radio band (88 MHz to 108 MHz). In the embodiment of the present invention, a wideband FM broadcast band (76 MHz to 108 MHz) that corresponds to both the Japanese FM broadcast band (76 MHz to 95 MHz) and the European FM radio band (88 MHz to 108 MHz) is frequency band H.

Each of the first to sixth embodiments and eighth to tenth embodiments of the present invention has a single feed point (feed portion) 5 that commonly feeds a signal (current) for both frequency band L and frequency band H. The seventh embodiment has a first feed point (feed portion) 6 for frequency band H and a second feed point (feed portion) 7 for frequency band H and frequency band L.

In the following description, antenna elements will be referred to as elements for simplification. Further, the glass antenna for the vehicle is referred to as the glass antenna.

First Embodiment

Figure 3:
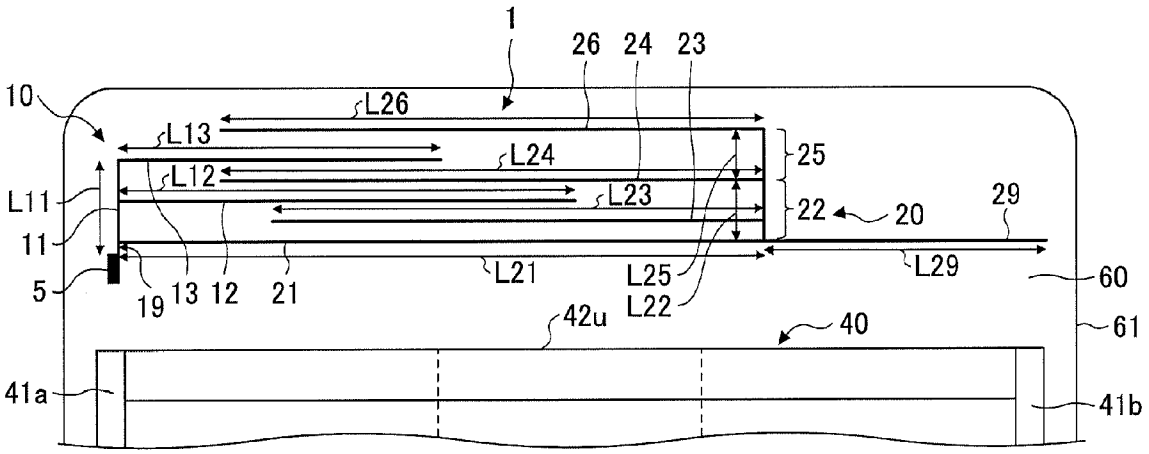
FIG. 3 is a plan view of the glass antenna according to the first embodiment of the present invention.

FIG. 3 is a plan view of a glass antenna 1 according to a first embodiment of the present invention.

The glass antenna 1 includes a first antenna conductor 10, a second antenna conductor 20, and the feed point 5. The feed point 5 is connected to the first antenna conductor 10 and the second antenna conductor 20.

The first antenna conductor 10 includes a vertical element 11 for feed connection, a first transverse element 12, and a second transverse element 13. The entire first antenna conductor 10 serves as an antenna conductor for frequency band H. The vertical element 11 for feed connection, the first transverse element 12, and the second transverse element 13 serve as H-oriented antenna elements.

The second antenna conductor 20 includes a transverse element 21 for feed connection, a vertical element 22 for connection, a third transverse element 23, a fourth transverse element 24, an upper vertical element 25, an upper transverse element 26, and an adjusting element 29. The second antenna conductor serves as both the L-oriented antenna conductor and the H-oriented antenna conductor.

Specifically, the transverse element 21 for feed connection, the third transverse element 23, and the fourth transverse element 24 serve as L-oriented antenna elements. The upper transverse element 26 serves as an H-oriented antenna element. The adjusting element 29 serves as an element that adjusts the H-oriented antenna element. The vertical element 22 for connection and the upper vertical element 25 serve as elements that adjust directivity.

In the first antenna conductor 10, the vertical element 11 for feed connection extends upwardly from the feed point 5 in the vertical direction or the substantially vertical direction. In particular, the vertical element 11 for feed connection extends in the perpendicular direction or in the substantially perpendicular direction.

The first transverse element 12 and the second transverse element 13 are connected to the vertical element 11 for feed connection. In the present embodiment, one end of the second transverse element 13 located above the first transverse element is connected to a terminal end of the vertical element 11 for feed connection. However, the present invention is not limited to this configuration. In the substantially vertical direction, the upper end of the vertical element 11 for feed connection may protrude from one end of the second transverse element 13.

Both the first transverse element 12 and the second transverse element 13, which are connected to the vertical element 11 for feed connection, extend in a direction away from the feed point side. However, the present invention is not limited to this configuration. In the horizontal direction, end portions of the first transverse element 12 and the second transverse element 13 may protrude from the transverse element 11 for feed connection.

In the second antenna conductor 20, the transverse element 21 for feed connection extends from the feed point 5 in the transverse direction or the substantially transverse direction. In particular, the transverse element 21 for feed connection extends in the horizontal direction or in the substantially horizontal direction. Although the transverse element 21 for feed connection serves as the L-oriented antenna element, this configuration can also improve the antenna gain for frequency band H.

Further, in the example illustrated in FIG. 2, the single feed point 5 is disposed in the left side region of the blank space of the rear window glass 60 as seen from the car-interior-side or the car-exterior-side. The transverse element 21 for feed connection is directly connected to the feed point 5. However, a relation of connection is not limited to this. As illustrated in the enlarged view (plan view) of FIG. 3, the transverse element 21 for feed connection may be connected to the feed point 5 via (connection portion 19 of) the vertical element 11 for feed connection of the first antenna conductor 10. That is, it is sufficient that the transverse element 21 for feed connection is electrically connected to the feed point 5 in a direct manner or in an indirect manner.

The vertical element 22 for connection is connected to a terminal end (right side of FIG. 3) of the transverse element 21 for feed connection. The vertical element 22 for connection is an element that adjusts directivity. The vertical element 22 for connection affects the directivity in frequency band H by changing its position.

In the configuration illustrated in FIG. 3, the vertical element 22 for connection is connected to the end portion (the other end) of the transverse element 21 for feed connection. However, the present invention is not limited to this. It is sufficient that the vertical element 22 for connection is connected to any position of the transverse element 21 for feed connection.

Similarly, the adjusting element 29 is connected to the end portion (lower end) of the vertical element 22 for connection. However, the present invention is not limited to this. It is sufficient that the adjusting element 29 is connected to any part of the vertical element 22 for connection.

According to the present embodiment, the third transverse element 23, the fourth transverse element 24, the upper vertical element 25, and the adjusting element 29 are connected to the vertical element 22 for connection.

The third transverse element 23 and the fourth transverse element 24, which are connected to the vertical element 22 for connection, substantially horizontally extend in a direction toward the feed point 5 from the vertical element 22 for connection. The upper transverse element 26, which is connected to the upper vertical element 25, substantially horizontally extends in the direction toward the feed point 5 from the upper vertical element 25.

The first transverse element 12 of the first antenna conductor 10 and the third transverse element 23 of the second antenna conductor 20 are adjacent to each other and capacitively coupled to each other to form a first capacitively-coupled portion. The second transverse element 13 of the first antenna conductor 10 and the fourth transverse element 24 of the second antenna conductor 20 are adjacent to each other and capacitively coupled to each other to form a second capacitively-coupled portion.

Because the two capacitively-coupled portions are disposed as described above, it becomes possible to significantly improve the antenna gain when receiving frequency band H (signal in frequency band H) in comparison with a case where only a single capacitively-coupled portion is disposed.

Further, according to the present embodiment, the upper transverse element 26 is disposed above the fourth transverse element 24 in the second antenna conductor 20. That is, the second antenna conductor 20 has another linear element in addition to the elements that form the capacitive coupling. The upper transverse element 26 is used to improve the gain for high frequency band H and to extend a receivable frequency band.

In FIG. 2, the upper vertical element 25 is connected to the vertical element 22 for connection. Further, the upper vertical element 25 and the vertical element 22 for connection integrally extend. As described above, although the upper vertical element 25 is connected to the upper end of the vertical element 22 for connection, the configuration of the upper element is not limited to this.

For example, the upper vertical element 25 may be connected to any part of the fourth transverse element 24 to extend upwardly without being connected to the vertical element 22 for connection. In this case, the upper transverse element 26, which is connected to the upper vertical element 25, extends from a starting point that is a position different from a position of the vertical element 22 for connection in the horizontal direction and extends towards the feed point 5 in the direction, which is the same as the extending direction of the fourth transverse element 24.

In the first capacitively-coupled portion, both the third transverse element 23 and the first transverse element 12 extend in the horizontal direction or the substantially horizontal direction, broadly in the transverse direction or the substantially transverse direction. The third transverse element 23 and the first transverse element 12 are parallel or substantially parallel to each other. In the present embodiment, the first transverse element 12 is disposed above the third transverse element 23.

Similarly, in the second capacitively-coupled portion, both the fourth transverse element 24 and the second transverse element 13 extend in the horizontal direction or the substantially horizontal direction. The fourth transverse element 24 and the second transverse element 13 are parallel or substantially parallel to each other. In the present embodiment, the fourth transverse element 24 is disposed above the second transverse element 13.

As described, in the present embodiment, the upper transverse element 26 is disposed above the second capacitively-coupled portion. Accordingly, the linear elements are alternately arranged from a side of the feed point 5 to a side of the upper transverse element 26 by arranging the capacitively-coupled portions as described above. Thereby, the antenna gain is improved.

Here, each of the third transverse element 23, the first transverse element 12, the second transverse element 13, and the fourth transverse element 24, which form the capacitive coupling, has an open end that is connected to nothing. More specifically, the other end, away from the feed point 5, of the first transverse element 12 is the open end, and the other end, located toward the feed point 5, of the third transverse element 23 is an open end. Also, the other end, away from the feed point 5, of the second transverse element 13 is an open end, and the other end, located toward the feed point 5, of the fourth transverse element 24 is an open end.

In order to deal with, as frequency band H, the entire frequency band (76 MHz to 108 MHz) included in the Japanese FM broadcast band, the US/European FM broadcast band, and a lower band of a television VHF band, it is preferable that the first capacitively-coupled portion, located on the lower side, has a length in a range of from 200 mm to 800 mm, and more preferably in a range of from 300 mm to 732 mm. Further, it is preferable that the second capacitively-coupled portion, located on the upper side, has a length in a range of from 230 mm to 430 mm, and more preferably in a range of from 264 mm to 344 mm.

Further, in the first capacitively-coupled portion and the second capacitively-coupled portion, it is preferable that distances between the elements that form the capacitive coupling are in a range of from 5 mm to 30 mm, and more preferably in a range of from 10 mm to 20 mm.

In an example illustrated in each of FIGS. 2 to 7 and FIGS. 10 to 12 according to the embodiment of the present invention, the first capacitively-coupled portion, the second capacitively-coupled portion, the transverse element 21 for feed connection, and the upper transverse element 26 are disposed on a left side of the vertical element 22 for connection as seen from the car-interior-side or the car-exterior-side.

Thus, the adjusting element 29 is disposed on a side opposite to the first capacitively-coupled portion and the second capacitively-coupled portion with respect to the vertical element 22 for connection for adjusting the directivity. In this way, because the capacitive coupling (first capacitively-coupled portion and second capacitively-coupled portion) and the adjusting element 29 are separately arranged, it becomes possible to ensure that each of the two capacitively-coupled portions, the transverse element 21 for feed connection, and the upper transverse element 26 has a required length. It becomes possible to ensure the antenna gain for frequency band L and improve the antenna gain for frequency band H by ensuring the lengths of the transverse elements 21, 23, 24, and 26 extending substantially horizontally.

Here, the center frequency of frequency band H has a wavelength of $\lambda$ in the air, glass has a shortening coefficient of wavelength of k, the formula of $k=0.64$ is established, and the formula of $\lambda g=\lambda \cdot k$ is established.

Specifically, it is preferable in terms of having non-directivity when receiving frequency band H that the vertical element 22 for connection is located within a range of 0.13 $\lambda g$ or shorter from the center of the rear window glass 60 in the left and right direction. It is more preferable to locate the vertical element 22 for connection within a range of from 0.04 $\lambda g$ to 0.1 $\lambda g$ from the center of the rear window glass 60 in the left and right direction.

Here, in the second antenna conductor 20, the vertical element 22 for connection for adjusting the directivity extends in the vertical direction or the substantially vertical direction of the rear window glass 60. However, the present invention is not limited to this arrangement. The vertical element 22 for connection is usable as an antenna element for adjusting the directivity as long as at least 50% of the total conductor length (total length) of the vertical element 22 for connection and the upper vertical element 25 extends in the vertical direction or the substantially vertical direction of the rear window glass 60.

It is preferable that a conductor length of a part, extending in the vertical direction or the substantially vertical direction, of the vertical element 22 for connection is in a range of from ($\lambda g/53$) to 600 mm. When the extending part has a conductor length of ($\lambda g/53$) or longer, the antenna gain for frequency band H can be advantageously improved in comparison with a case where the extending portion has a conductor length of shorter than ($\lambda g/53$).

Specifically, in order to deal with frequency band H (76 MHz to 108 MHz) in the embodiment of the present invention, it is preferable that a conductor length of a part extending in the vertical direction or the substantially vertical direction, which is a total length of the vertical element 22 for connection and the upper vertical element 25 in the vertical direction or the substantially vertical direction, is in a range of from 40 mm to 600 mm. It is more preferable that the conductor length of the part is in a range of from 50 mm to 500 mm, and especially preferably in a range of from 60 mm to 400 mm.

When the total length of the vertical element 22 for connection and the upper vertical element 25 is 600 mm or shorter, the antenna can be advantageously made more compact in comparison with a case where the length is longer than 600 mm. It is preferable that the conductor length of the part is in a range of from ($\lambda g/41.7$) to 500 mm, and especially preferably in a range of from ($\lambda g/34.8$) to 400 mm.

It is preferable in the embodiment of the present invention that a distance between a group of the first capacitively-coupled portion and a group of the second capacitively-coupled portion, that is an average distance between the first transverse element 12 and the fourth transverse element 24 is in a range of from 10 mm to 30 mm, and more preferably in a range of from 15 mm to 20 mm.

Specifically, when the average distance is 10 mm or longer, the antenna gain can be advantageously improved in comparison with a case where the average distance is shorter than 10 mm. When the average distance is 30 mm or shorter, the antenna can be advantageously closer to a non-directional antenna in comparison with a case where the average distance is longer than 30 mm.

The antenna gain can be improved in a case where the upper elements 25 and 26 are disposed to have a predetermined length. Thus, the respective upper elements 25 and 26 are disposed to have appropriate conductor lengths in consideration of the following route length (total length).

For example, it is preferable that, excluding a length of the feed point, a route length of a route from the feed point to a leading end of the upper transverse element 26 through the connection portion 19, the transverse element 21 for feed connection, the vertical element 22 for connection, the upper vertical element 25, and the upper transverse element 26 in that order is in a range of from (0.15+0.5n) λg to (0.45+0.5n) λg where n is an integer number. Details will be described later with reference to practical examples.

Figure 6:
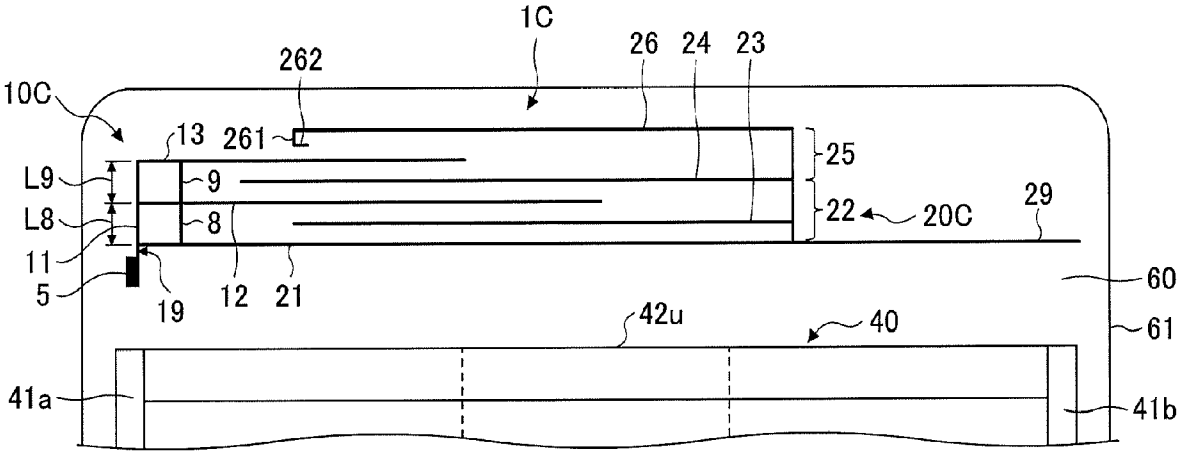
FIG. 6 is a plan view of a glass antenna according to a fourth embodiment of the present invention.

Here, a leading end of the upper transverse element 26 does not have to be the open end. The leading end of the upper transverse element 26 may be bent or folded (turned back). For example, as illustrated in FIG. 6, the leading end of the upper transverse element 26 may be folded. That is, after extending in the direction same as the extending direction of the third transverse element 23 (direction toward the feed point 5), the upper transverse element 26 may be folded by an upper folded vertical element 261 and an upper folded transverse element 262 to extend in the direction same as the extending direction of the first transverse element 12 (direction away from the feed point 5). In other words, the upper transverse element 26 may have a portion, extending substantially horizontally in the direction toward the feed point 5, and the upper transverse element 26 may be folded to have a portion (the upper folded transverse element 262) extending substantially horizontally in the direction away from the feed point 5.

In this case, it is preferable that a total length obtained by adding a length (element length) of the upper folded vertical element 261 and a length (element length) of the upper folded transverse element 262 to the above described route length from the connection portion 19 to the leading end of the upper transverse element 26 through the connection portion 19, the transverse element 21 for feed connection, the vertical element 22 for connection, the upper vertical element 25, and the upper transverse element 26 is set to be in the range of from (0.15+0.5n) λg to (0.45+0.5n) λg. In other words, in a case where the upper transverse element 26 is folded, it is preferable that the length from the feed point to the terminal end of the folded portion through the elements 19, 21, 22, 25, 26, 261, and 262 is in the range of from (0.15+0.5n) λg to (0.45+0.5n) λg.

Second Embodiment

Figure 4:
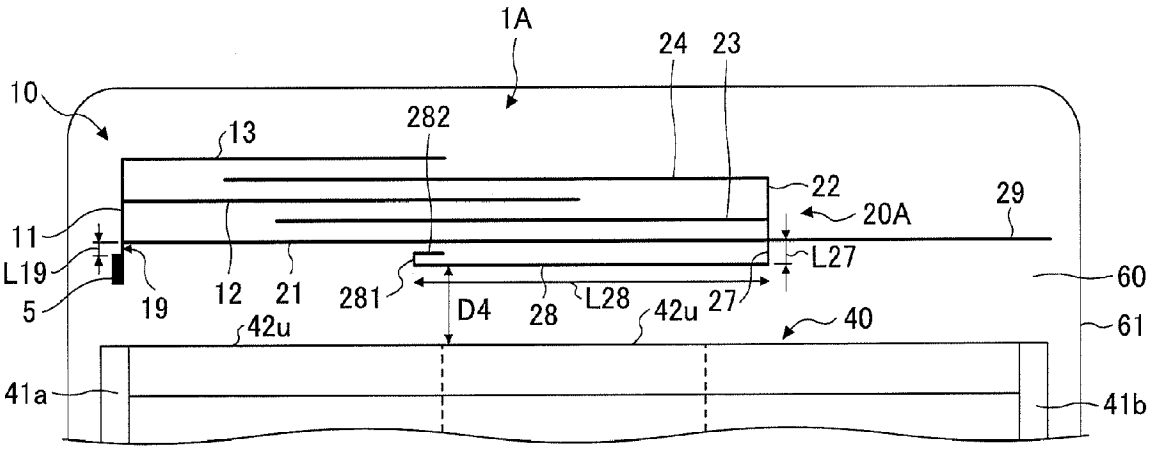
FIG. 4 is a plan view of a glass antenna according to a second embodiment of the present invention.

FIG. 4 is a plan view of a glass antenna 1A according to a second embodiment of the present invention.

The second embodiment differs from the first embodiment illustrated in FIG. 3 in that a second antenna conductor 20A does not have the upper elements 25 and 26 but does have lower elements 27 and 28.

Specifically, in the second embodiment, the lower vertical element 27 and the lower transverse element 28 are disposed as lower elements below the transverse element 21 for feed connection.

Here, the lower vertical element 27 is disposed on a right side area with respect to the center of the rear window glass 60 in the left and right direction as seen from the car-interior-side or the car-exterior-side. The lower vertical element 27 extends downwardly in the vertical direction or the substantially vertical direction. The lower transverse element 28 is connected to an end portion of the lower vertical element 27 (first lower vertical element).

In the example illustrated in FIG. 4, one lower transverse element 28 is arranged below the transverse element 21 for feed connection. However, a plurality of lower transverse elements 28 may be arranged in accordance with a size of the blank space of the window glass as a variation example of the present embodiment.

In this case, in order to improve the antenna gain in the above described frequency band H (76 MHz to 108 MHz), it is preferable that distances between the plurality of lower elements are in a range of from 5 mm to 25 mm, and more preferably in a range of from 10 mm to 20 mm.

Figure 5:
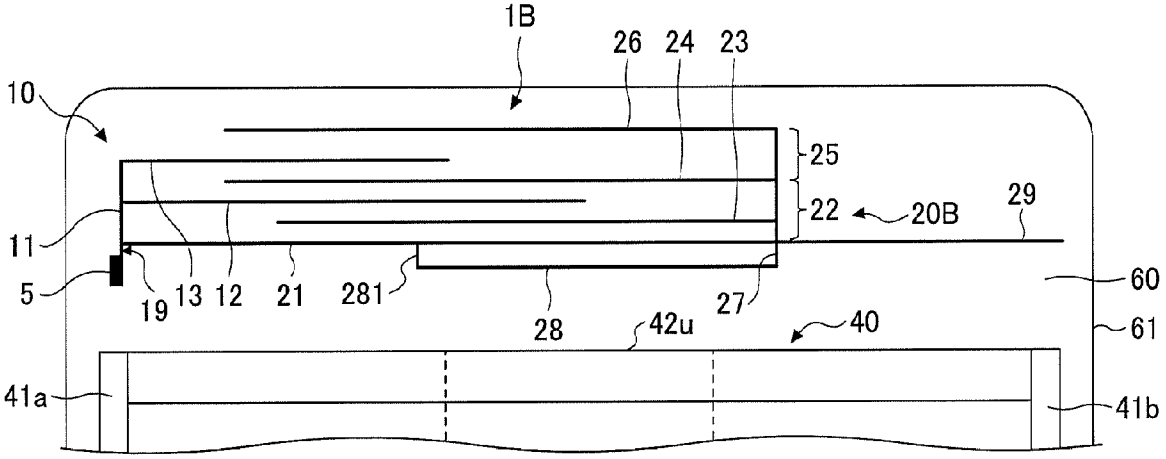
FIG. 5 is a plan view of a glass antenna according to a third embodiment of the present invention.

Further, as illustrated in FIG. 5, as a configuration element of the lower element, a second lower vertical element 281 connected to the transverse element 21 for feed connection may be disposed to form a loop. Specifically, one end of the second lower vertical element 281 is connected to the other end of the lower transverse element 28, and the other end of the second lower vertical element 281 is connected to the transverse element 21 for feed connection. In this configuration, the transverse element 21 for feed connection, the lower vertical element 27, the lower transverse element 28, and the second lower vertical element 281 form the lower loop. The antenna gain for frequency band H is improved by forming the lower loop.

The antenna gain can be improved in a case where the lower elements 27 and 28 are disposed to have a predetermined length. Thus, the respective lower elements 27 and 28 are disposed to have appropriate conductor lengths in consideration of the following route length.

For example, it is preferable that, excluding the length of the feed point, a route length of a route from the feed point to a leading end of the lower transverse element 28 through the connection portion 19, the transverse element 21 for feed connection, the lower vertical element 27, and the lower transverse element 28 in that order is in a range of from 0.57 λg to 0.62 λg. Details will be described later with reference to practical examples.

Here, a leading end of the lower transverse element 28 does not have to be the open end. In a case where the loop is formed as described above, it is preferable that a total length obtained by adding a length (element length) of the second lower vertical element 281 to the above described route length from the connection portion 19 to the leading end of the lower transverse element 28 through the connection portion 19, the transverse element 21 for feed connection, the lower vertical element 27, and the lower transverse element 28 is set to be in the above described range of from 0.57 λg to 0.62 λg. In other words, in a case where the lower loop is formed, it is preferable that the length from the feed point to the terminal end of the lower loop through the elements 19, 21, 27, 28, and 281 is in the range of from 0.57 λg to 0.62 λg.

Figure 7:
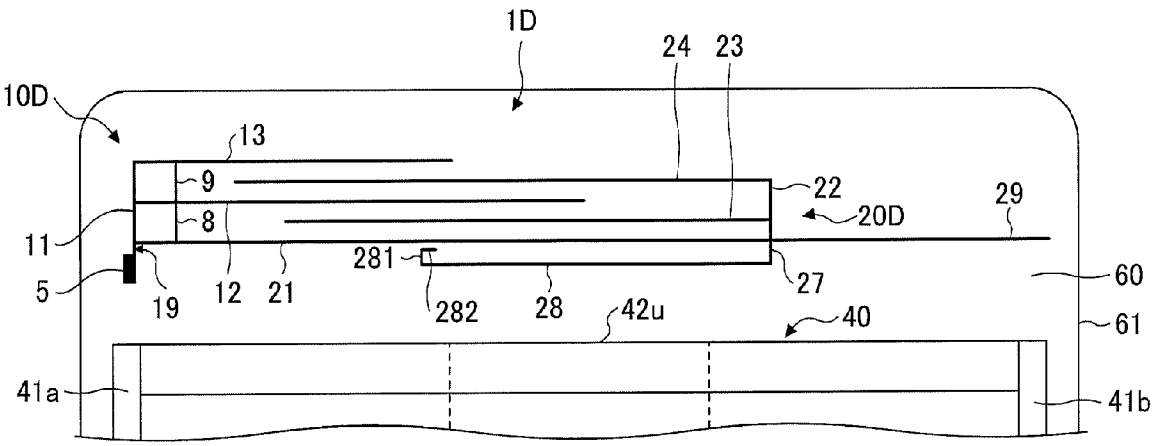
FIG. 7 is a plan view of a glass antenna according to a fifth embodiment of the present invention.

Further, as illustrated in FIG. 4 or FIG. 7, the leading end of the lower transverse element 28 may be folded. That is, after extending in the direction same as the extending direction of the third transverse element 23 (direction toward the feed point 5), the lower transverse element 28 may be folded by a lower folded vertical element 281 and a lower folded transverse element 282 to extend in the direction same as the extending direction of the first transverse element 12 (direction away from the feed point 5). In other words, the lower transverse element 28 may have a portion, extending substantially horizontally in the direction toward the feed point 5, and the lower transverse element 28 may be folded to have a portion (the lower folded transverse element 282) extending substantially horizontally in the direction away from the feed point 5.

In this case, it is preferable that a total length obtained by adding lengths of the lower folded vertical element 281 and the lower folded transverse element 282, which are the folded elements, to the above described route length from the connection portion 19 to the leading end of the lower transverse element 28 through the connection portion 19, the transverse element 21 for feed connection, the lower vertical element 27, and the lower transverse element 28 is set to be in the above described range of from 0.57 λg to 0.62 λg. In other words, in a case where the lower transverse element 28 is folded, it is preferable that the length from the feed point to the terminal end of the folded portion through the elements 19, 21, 27, 28, 281 and 282 is in the range of from 0.57 λg to 0.62 λg.

Third Embodiment

FIG. 5 is a plan view of a glass antenna 1B according to a third embodiment of the present invention. The third embodiment differs from the first embodiment illustrated in FIG. 3 and the second embodiment illustrated in FIG. 4 in that both of the upper elements 25 and 26 and the lower elements 27 and 28 are disposed on a second antenna conductor 20B.

According to the third embodiment, it becomes possible to obtain both the advantages obtained by disposing the upper elements 25 and 26 in the first embodiment and the advantages obtained by disposing the lower elements 27 and 28 in the second embodiment.

Here, the upper elements and the lower elements are disposed to have respective appropriate lengths in order to improve the antenna gain that periodically changes depending on influences mutually given to the upper elements 25 and 26 and the lower elements 27 and 28. Details will be described in practical examples.

For example, when the length of the lower elements (27+28) is fixed to be 440 mm, it is preferable that, excluding the length of the feed point, a route length of a route from the feed point to the leading end of the upper transverse element 26 through the connection portion 19, the transverse element 21 for feed connection, the vertical element 22 for connection, the upper vertical element 25, and the upper transverse element 26 in that order is in a range of from (0.15+0.5n) λg to (0.45+0.5n) λg where n is an integer number. Details will be described later with reference to practical examples.

Here, also in the present embodiment, the leading end of the upper transverse element 26 does not have to be the open end. The leading end of the upper transverse element 26 may be bent or folded (turned back). For example, in a case where the leading end of the upper transverse element 26 is folded as illustrated in FIG. 6, it is preferable that a total length obtained by adding the length of the upper folded vertical element 261 and the length of the upper folded transverse element 262 to the route length from the connection portion 19 to the leading end of the upper transverse element 26 through the connection portion 19, the transverse element 21 for feed connection, the vertical element 22 for connection, the upper vertical element 25, and the upper transverse element 26 is set to be in the above described range of from (0.15+0.5n) λg to (0.45+0.5n) λg where the length of the lower elements 27 and 28 is fixed to be 440 mm.

Fourth Embodiment

FIG. 6 is a plan view of a glass antenna 1C according to a fourth embodiment of the present invention. The fourth embodiment differs from the first embodiment illustrated in FIG. 3 in that loop forming elements 8 and 9 connected (short-circuited) to a first antenna conductor 10C and a second antenna conductor 20C are further disposed.

That is, as illustrated in FIG. 6, the glass antenna 1C according to the fourth embodiment includes the upper elements 25 and 26 and the loop forming elements 8 and 9.

Here, the two loop forming elements 8 and 9 are disposed in FIG. 6. However, it is not necessary to have both the first loop forming element 8, which short-circuits the transverse element 21 for feed connection and the third transverse element 23, and the second loop forming circuit 9, which short-circuits the third transverse element 23 and the fourth transverse element 24. The embodiment may have at least one of the loop forming elements 8 and the 9.

Because the loop forming elements 8 and 9 substantially vertically extend, an element length of the loop forming element 8 corresponds to the distance between the transverse element 21 for feed connection and the first transverse element 12 and an element length of the loop forming element 9 corresponds to the distance between the first transverse element 12 and the second transverse element 13. Here, the first transverse element 12, the second transverse element 13, and the transverse element 21 for feed connection substantially horizontally extend.

Accordingly, in order to improve the directivity of frequency band H (76 MHz to 108 MHz), it is preferable that element lengths of the loop forming elements 8 and 9 are in a range of from 5 mm to 60 mm, and more preferably in a range of from 10 mm to 40 mm.

Fifth Embodiment

FIG. 7 is a plan view of a glass antenna 1D according to a fifth embodiment of the present invention. The fifth embodiment differs from the second embodiment illustrated in FIG. 4 in that the loop forming elements 8 and 9 connected (short-circuited) to a first antenna conductor 10D and a second antenna conductor 20D are further disposed. The loop forming elements 8 and 9 have configurations similar to those of the fourth embodiment illustrated in FIG. 6.

That is, as illustrated in FIG. 7, the glass antenna 1D according to the fifth embodiment includes the lower elements 27 and 28 and the loop forming elements 8 and 9.

Sixth Embodiment

Figure 8:
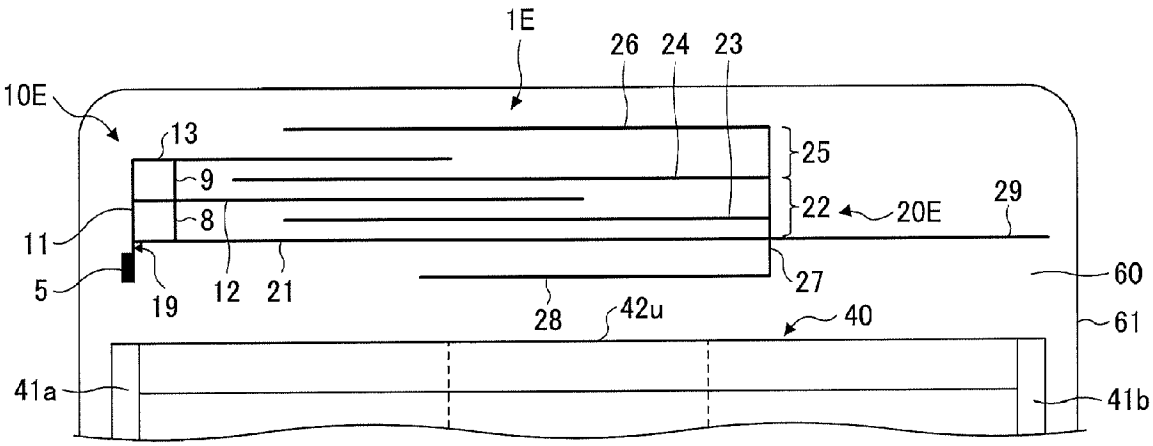
FIG. 8 is a plan view of a glass antenna according to a sixth embodiment of the present invention.

FIG. 8 is a plan view of a glass antenna 1E according to a sixth embodiment of the present invention. The sixth embodiment differs from the third embodiment illustrated in FIG. 5 in that the loop forming elements 8 and 9 connected (short-circuited) to a first antenna conductor 10E and a second antenna conductor 20E are further disposed. The loop forming elements 8 and 9 have configurations similar to those of the fourth embodiment illustrated in FIG. 6.

That is, as illustrated in FIG. 8, the glass antenna 15 according to the sixth embodiment includes the upper elements 25 and 26, the lower elements 27 and 28, and the loop forming elements 8 and 9.

Seventh Embodiment

Figure 9:
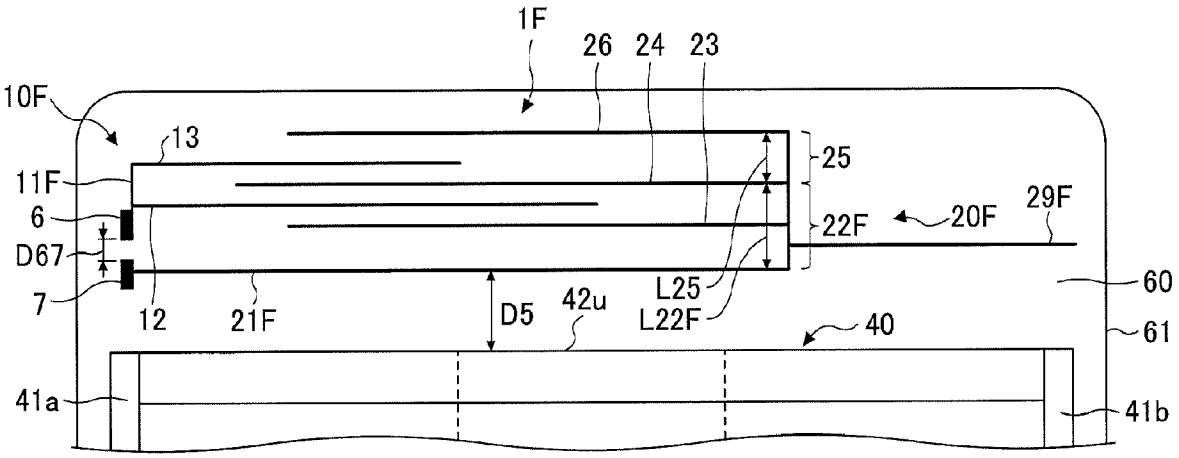
FIG. 9 is a plan view of a glass antenna according to a seventh embodiment of the present invention.

FIG. 9 is a plan view of a glass antenna 1F according to a seventh embodiment of the present invention. The seventh embodiment differs from the first embodiment illustrated in FIGS. 2 and 3 in that the feed point is separated into a first feed point 6 and a second feed point 7. In other words, the seventh embodiment has the first feed point 6 used for high frequency band H, which is higher than frequency band L, and the second feed point 7 mainly used for frequency band L.

Specifically, in the seventh embodiment, a vertical element 11F for feed connection of the first antenna conductor 10F is connected to the first feed point 6. Further, a transverse element 21F for feed connection of the second antenna conductor 20F is not connected to the vertical element 11F for feed connection but is directly connected to the second feed point 7.

It is preferable that the shortest distance D67 between the first feed point 6 and the second feed point 7 is in a range of from 0.1 mm to 200 mm. When the shortest distance is 0.1 mm or longer, it becomes advantageously easy to produce the antenna in comparison with a case where the shortest distance is shorter than 0.1 mm. The shortest distance is preferably 200 mm or shorter because of having more convenient mounting in comparison with a case where the shortest distance is longer than 200 mm. The shortest distance is more preferably in a range of from 1 mm to 100 mm, and especially preferably in a range of from 2 mm to 50 mm.

Here, the transverse element 21F for feed connection is directly connected to the second feed point 7 in the example illustrated in FIG. 9. However, the present invention is not limited to this arrangement. The transverse element 21F for feed connection may be connected to the second feed point 7 via a connecting element (an element that does not contact the first antenna conductor 10, for example). That is, it is sufficient that the transverse element 21F for feed connection is electrically connected to the second feed point 7.

Further, although the adjusting element 29 is connected to the end portion (lower end) of the vertical element 22 for connection in the first to sixth embodiments, the adjusting element 29 is connected to a part, which is not the end portion, of the vertical element 22F for connection in the present embodiment illustrated in FIG. 9.

Further, in the seventh embodiment, the antenna gain can be improved in a case where the upper elements 25 and 26 are disposed to have a predetermined length. Thus, the respective upper elements 25 and 26 are disposed to have appropriate conductor lengths in consideration of the following route length.

For example, it is preferable that, excluding the length of the feed point, a route length of a route from the feed point to the leading end of the upper transverse element 26 through the connection portion 19, the transverse element 21F for feed connection, the vertical element 22F for connection, the upper vertical element 25, and the upper transverse element 26 in that order is in a range of from (0.15+0.5n) λg to (0.45+0.5n) λg where n is an integer number.

Here, in a case where the folded portion is formed on the leading end of the upper transverse element 26, similar to the first embodiment, it is preferable that the total length including the folded portion is set to be in the above described range.

Eighth Embodiment

Figure 10:
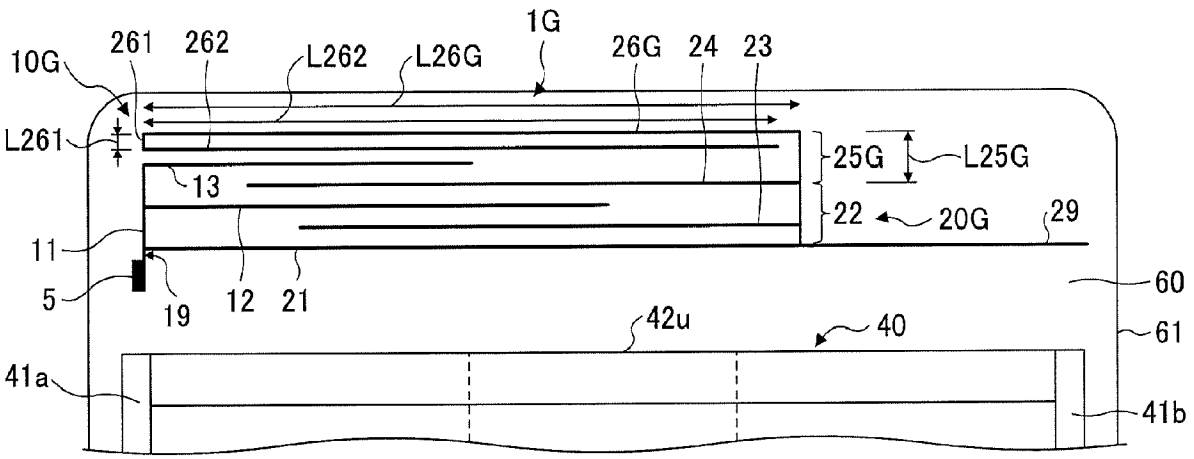
FIG. 10 is a plan view of a glass antenna according to an eighth embodiment of the present invention.

FIG. 10 is a plan view of a glass antenna 1G according to an eighth embodiment of the present invention. The eighth embodiment differs from the first embodiment illustrated in FIGS. 2 and 3 in that a leading end of an upper transverse element 26G is not the open end but folded (turned back) downwardly.

As illustrated in FIG. 10, the leading end of the upper transverse element 26G is downwardly folded. That is, after extending in the direction same as the extending direction of the third transverse element 23, the upper transverse element 26G is downwardly folded by the upper folded vertical element 261 and the upper folded transverse element 262 to extend in the direction same as the extending direction of the first transverse element 12.

In this case, it is preferable that a total length of the route length from the connection portion 19 to the leading end of the upper folded transverse element 262 through the connection portion 19, the transverse element 21 for feed connection, the vertical element 22 for connection, the upper vertical element 25, the upper transverse element 26G, the upper folded vertical element 261, and the upper folded transverse element 262 is set to be in the above described range of from (0.15+0.5n) λg to (0.45+0.5n) λg.

Further, in order to improve the antenna gain in the above described frequency band H (76 MHz to 108 MHz), it is preferable that a distance between the upper folded transverse element 262 and the upper transverse element 26G, which is the length of the upper folded vertical element 261, is in a range of from 5 mm to 25 mm, and more preferably in a range of from 10 mm to 20 mm.

Similarly, it is preferable in terms of improving the antenna gain for frequency band H that a distance between the upper transverse element 26G and the second transverse element 13 of the first antenna conductor 10 is in a range of from 5 mm to 25 mm, and more preferably in a range of from 10 mm to 20 mm.

Here, in FIG. 10, the upper transverse element 26G is folded by the upper folded vertical element 261 to downwardly extend after extending to a position above the feed point 5 and the vertical element 11 for feed connection. However, the upper transverse element 26G may be folded before reaching the position above the feed point 5 and the vertical element 11 for feed connection as illustrated in FIG. 6. Further, it is not necessary to dispose the upper folded transverse element 262.

Ninth Embodiment

Figure 11:
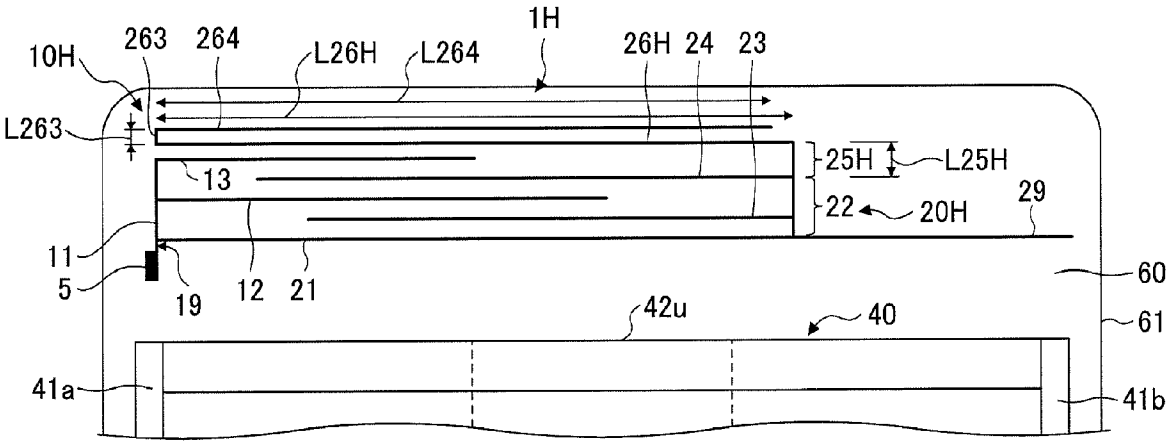
FIG. 11 is a plan view of a glass antenna according to a ninth embodiment of the present invention.

FIG. 11 is a plan view of a glass antenna 1H according to a ninth embodiment of the present invention. The ninth embodiment differs from the first embodiment illustrated in FIGS. 2 and 3 in that a leading end of an upper transverse element 26H is not the open end but the upper transverse element 26H is upwardly folded.

As illustrated in FIG. 11, the leading end of the upper transverse element 26H is upwardly folded. That is, after extending in the direction same as the extending direction of the third transverse element 23, the upper transverse element 26H is upwardly folded by an upper folded vertical element 263 and an upper folded transverse element 264 to extend in the direction same as the extending direction of the first transverse element 12.

In this case, it is preferable that a total length of the route length from the connection portion 19 to the leading end of the upper folded transverse element 264 through the connection portion 19, the transverse element 21 for feed connection, the vertical element 22 for connection, the upper vertical element 25H, the upper transverse element 26H, the upper folded transverse element 263, and the upper folded transverse element 264 is set to be in the above described range of from (0.15+0.5n) λg to (0.45+0.5n) λg.

Further, in order to improve the above described antenna gain in frequency band H (76 MHz to 108 MHz), it is preferable that a distance between the upper transverse element 26H and the upper folded transverse element 264, which is the length of the upper folded vertical element 263, is in a range of from 5 mm to 25 mm, and more preferably in a range of from 10 mm to 20 mm.

Similarly, it is preferable in terms of improving the antenna gain for frequency band H that a distance between the upper folded transverse element 264 and the second transverse element 13 of the first antenna conductor 10 is in a range of from 5 mm to 25 mm, and more preferably in a range of from 10 mm to 20 mm.

Here, the upper transverse element 26H is folded by the upper folded vertical element 263 to extend upwardly after extending to a position above the feed point 5 and the vertical element 11 for feed connection in FIG. 11. However, the upper transverse element 26H may be folded before reaching the position above the feed point 5 and the vertical element 11 for feed connection. Further, it is not necessary to dispose the upper folded transverse element 264.

Tenth Embodiment

Figure 12:
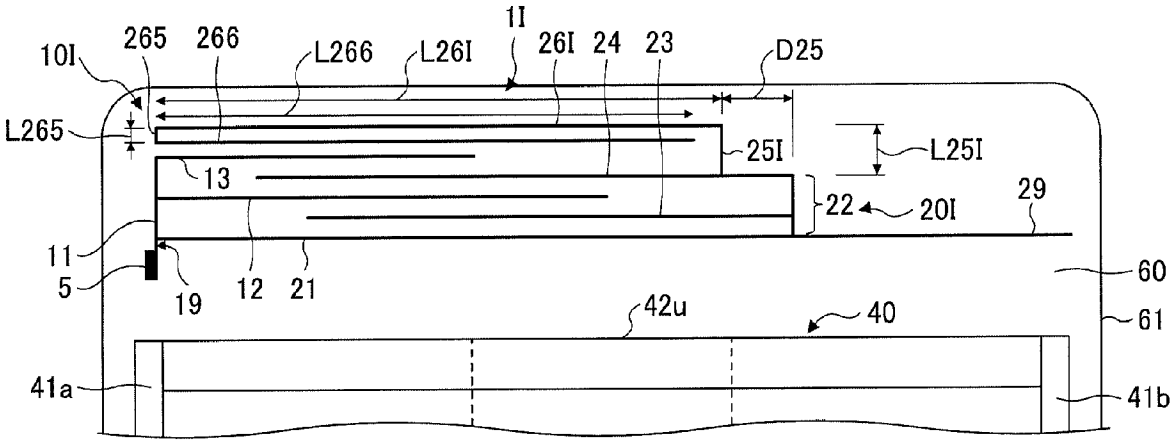
FIG. 12 is a plan view of a glass antenna according to a tenth embodiment of the present invention.

FIG. 12 is a plan view of a glass antenna 1I according to a tenth embodiment of the present invention. The tenth embodiment differs from the eighth embodiment illustrated in FIG. 10 in that the other end of an upper vertical element 25I is not connected to the other end of the vertical element 22 for connection but connected to the fourth transverse element 24.

As illustrated in FIG. 12, the upper vertical element 25I is connected to the fourth transverse element 24 and extends upwardly. One end of an upper transverse element 26I is connected to the upper end of the upper vertical element 25I and is located above the fourth transverse element 24 at a midway position of the fourth transverse element 24. Then, after extending from the position in the direction same as the extending direction of the third transverse element 23, the upper transverse element 26I is downwardly folded by an upper folded transverse element 265 and an upper folded transverse element 266 to extend in the direction same as the extending direction of the first transverse element 12.

In this case, a length (distance D25) on the fourth transverse element 24 from the upper end of the transverse element 22 for connection to the lower end of the upper vertical element 25I is included in the longest route length of the antenna elements from the feed point. Here, it is preferable that a total length of the route length from the connection portion 19 to the leading end of the upper folded transverse element 266 through the connection portion 19, the transverse element 21 for feed connection, the vertical element 22 for connection, the distance D25, the upper vertical element 25I, the upper transverse element 26I, the upper folded transverse element 265, and the upper folded transverse element 266 is set to be in the above described range of from $(0.15+0.5n)\ \lambda g$ to $(0.45+0.5n)\ \lambda g$.

Further, in order to improve the antenna gain in the above described frequency band H (76 MHz to 108 MHz), it is preferable that a distance between the upper folded transverse element 266 and the upper transverse element 26I, which is the length of the upper folded transverse element 265, is in a range of from 5 mm to 25 mm, and more preferably in a range of from 10 mm to 20 mm.

Similarly, it is preferable in terms of improving the antenna gain for frequency band H that a distance between the upper transverse element 26I and the second transverse element 13 of the first antenna conductor 10 is in a range of from 5 mm to 25 mm, and more preferably in a range of from 10 mm to 20 mm.

Here, the upper transverse element 26I is folded by the upper folded vertical element 265 to extend downwardly after extending to a position above the feed point 5 and the vertical element 11 for feed connection in FIG. 12. However, the upper transverse element 26I may be folded before reaching the position above the feed point 5 and the vertical element 11 for feed connection as illustrated in FIG. 6. Further, it is not necessary to dispose the upper folded transverse element 266.

The position of the starting point (lower end) of the upper vertical element 25I is different from the upper end of the vertical element 22 for connection. However, it is preferable that a range (separating distance D25), where the starting point of the upper vertical element 25I can move, is a range where the upper vertical element 25I does not contact the second transverse element 13. It is more preferable that the upper vertical element 25I is located at a position located 5 mm or more away from the end portion of the second transverse element 13.

Variation Example

Each of the first antenna conductor 10, the second antenna conductor 20, the feed point 5, the first feed point 6, the second feed point 7 and the defogger 40 is normally formed by printing paste containing conductive metal, such as silver paste, on a car-interior-side surface of the rear window glass and baking the printed paste. However, the present invention is not limited to this forming method. A linear member or foil member, which contains a conductive substance, such as copper, may be formed on the car-interior-side surface or the car-exterior-side surface of the rear window glass 60, or in the rear window glass 60. Further, a synthetic resin film, which has a conductive layer formed therein or thereon, may be disposed on the car-interior-side surface or the car-exterior-side surface of the rear window glass 60 so that respective sections of the conductive layer serve as the first antenna conductor 10, the second antenna conductor 20 and the like.

In the embodiments of the present invention, the rear window glass 60 may have a light-shielding film formed thereon so that at least one of the L-oriented antenna conductor, the feed point 5, the first feed point 6, and the second feed point 7 is disposed on the shielding film. The shielding film may be a ceramic film, such as a black ceramic film.

Here, because the vehicle is a moving body, it is preferable to dispose a plurality of antennas and to have a radio selection capability (to perform diversity reception in cooperation) for switching to any one of antennas, which has a high receiving sensitivity, depending on a location.

Thus, in the embodiments of the present invention, an auxiliary antenna for receiving frequency band L and frequency band H may be disposed on the window glass 60. When the auxiliary antenna is mounted on the window glass 60 to switch the antenna, it becomes possible to obtain an effect of improving the reception performance. Here, the glass antenna and the auxiliary antenna may perform the diversity reception in cooperation. The auxiliary antenna may receive at least one of frequency band L and frequency band H.

Further, the auxiliary antenna may be disposed on another part (a front window glass, a shark-fin, or a spoiler, for example), which is different from the part where the glass antenna according to the embodiment of the present invention is disposed, so that they can be alternately (selectively) switched.

Further, a different type of antenna (heterogeneous antenna) for another use that receives other frequencies may be disposed on the rear glass. For example, the different type of antenna may receive broadcast waves (such as DAB)

higher than frequency band H. In this case, it is preferable to dispose the different type of antenna, above the adjusting element 29, at a side (right side in FIG. 2) away from the feed point 5 with respect to the vertical element 22 for connection when disposing the different type of antenna on the rear window glass.

In a case where the different type of antenna is disposed, the glass antenna according to the embodiment of the present invention can be used to adjust receiving characteristics of the high broadcast waves (DAB).

Although the glass antenna and the window glass according to the embodiments have been specifically described, the present invention is not limited to the above described embodiments. These embodiments may be combined as appropriate and various variations and modifications may be made without departing from the spirit and scope of the present invention.

In the following, practical examples are described.

Practical Example 1

The rear window glass 60 for an automobile (vehicle) was used to produce each automobile glass antenna of which a length (L25+L26 (+L261+L262)) of the upper elements 25 and 26 is different according to the first embodiment illustrated in FIG. 3 and the eighth embodiment illustrated in FIG. 10. Here, for each different antenna length, frequency-antenna gain characteristics were measured to calculate average characteristics. In contrast to practical example 5 that will be described later, the lower elements were not disposed in practical example 1.

The antenna gains in an electric field of 60 dBμV/m were measured for every 3 degrees in the range of 0 to 360 degrees in the horizontal direction as seen from the automobile. Although the number of heater strips 42 illustrated in FIG. 2 is 11, 14 heater strips 42 were used to the measurement.

In this practical example, the average antenna gains in the range of 0 to 360 degrees were adopted. The measurement conditions for this practical example are also applicable to the graphs illustrated in FIGS. 13 to 32.

The dimension of each element of the glass antenna of the first embodiment (and the eighth embodiment) is as follows. L represents a conductor length of each element.

| | |
|---|---|
| L11 | 80 mm |
| L12 | 550 mm |
| L13 | 390 mm |
| L19 | 5 mm |
| L21 | 770 mm |
| L22 | 60 mm |
| L23 | 585 mm |
| L24 | 650 mm |
| L29 | 335 mm |

Here, distances between the elements facing each other that form the first capacitively-coupled portion and the second capacitively-coupled portion were set to be 10 mm. Smaller one of angles formed by the rear window glass 60 and the horizontal direction was set to be 24.4 degrees.

A vertical size of the feed point was set to be 27 mm and a transverse size of the feed point was set to be 14 mm. A line width of each element was set to be 0.8 mm.

Further, arrangement of the glass antenna 1 in the rear window glass 60 was as follows (see FIGS. 2 and 4). D1 represents a distance between a side edge 61*s* of the vehicle body opening edge (edge portion of the rear window glass) 61 and the vertical element 11 for feed connection, D2 represents a distance between an upper edge 61*u* of the vehicle body opening edge 61 and the second transverse element 13, and D4 represents a distance between the uppermost heater strip 42*u* and the lower transverse element 28. Ww represents a transverse width of the rear window glass 60. Wh represents a vertical width of the rear window glass 60.

| | |
|---|---|
| D1 | 20 mm |
| D2 | 45 mm |
| D4 | 40 mm |
| Ww60 | 1320 mm |
| Wh60 | 700 mm |

In this practical example, a length (L25+L26 (+L261+L262)) of the upper elements in the glass antenna was changed in 16 ways from, 0 (no upper element), 145, 245, 345, 445, 545, 645, 745, 845, 945, 1045, 1145, 1245, 1345, 1445, to 1545 mm.

Here, based on each of these lengths, an antenna length (total length of the above described route) from the feed point 5 is converted to a wavelength where fractional shortening (shortening coefficient) k is 0.64, the center frequency of frequency band H, which is 92 MHz, has a wavelength of λ in the air, and the formula of $\lambda g=\lambda \cdot k$ is established. The respective antenna lengths correspond to 0.40, 0.47, 0.52, 0.57, 0.61, 0.66, 0.71, 0.76, 0.81, 0.85, 0.90, 0.95, 1.00, 1.04, 1.09, and 1.14 λg.

Specifically, the antenna length was defined by the total length (L19+L21+L22+L25+L26 (+L261+L262)) from "feed point" to "leading end of element". A starting point of a graph in each of FIGS. 13 and 14 is 0.40 λg, which corresponds to 835 mm (L19: 5 mm+L21: 770 mm+L22: 60 mm).

In this practical example, the upper element was downwardly folded as illustrated in FIG. 10 when the upper element was extended. Dimensions in a case where the longest length of the upper elements (L25G+L26G+L261+L262) is 1545 mm in the measurements were as follows.

| | |
|---|---|
| L25G | 40 mm |
| L26G | 770 mm |
| L261 | 10 mm |
| L262 | 725 mm |

Figure 13:
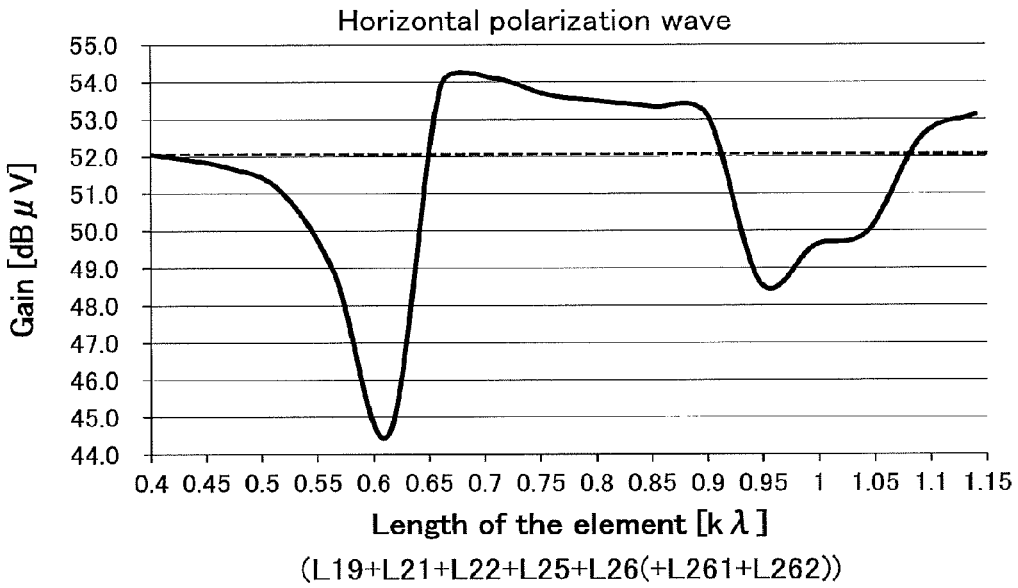
FIG. 13 is a graph illustrating average antenna gains of horizontally polarized waves in the entire frequency band of 76 MHz to 108 MHz when a length of upper elements was changed in a direction illustrated in FIG. 10 in a configuration of FIG. 3 having the upper elements.
Figure 14:
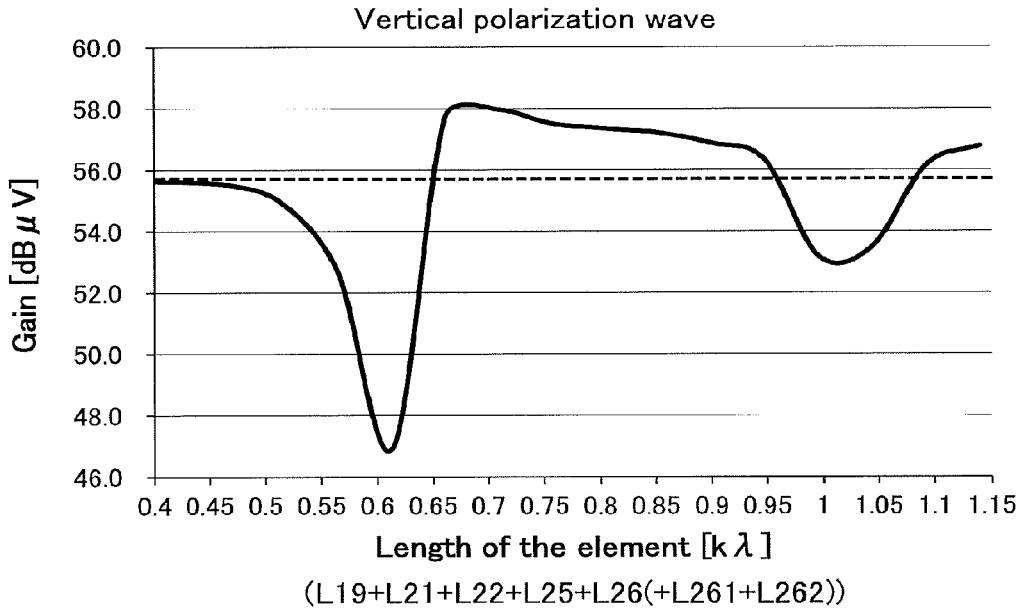
FIG. 14 is a graph illustrating average antenna gains of vertically polarized waves in the entire frequency band of 76 MHz to 108 MHz when the length of the upper elements was changed in the direction illustrated in FIG. 10 in the configuration of FIG. 3 having the upper elements.

FIG. 13 is a graph illustrating average antenna gains of horizontally polarized waves (horizontal polarization waves) in the entire frequency band of 76 MHz to 108 MHz when the length of the upper elements was changed in the direction illustrated in FIG. 10 in the configuration of FIG. 3 having the upper elements. Here, as illustrated in FIG. 10, the upper element was downwardly folded when the upper element was extended in this practical example.

FIG. 14 is a graph illustrating average antenna gains of vertically polarized waves (vertical polarization waves) in the entire frequency band of 76 MHz to 108 MHz when the length of the upper elements was changed in the direction illustrated in FIG. 10 in the configuration of FIG. 3 having the upper elements.

It is proved from the graphs illustrated in FIGS. 13 and 14 that a range of from 0.65 λg to 0.95 λg is effective in comparison with a case (left end of graph) where the upper elements were not disposed.

Further, it is proved from right sides of the graphs that the antenna gain is improved when the length is 1.05 λg or longer. As illustrated in the graphs in FIGS. 13 and 14, because the gain was improved at least in the range of from 0.65 λg to 0.95 λg and in the range of 1.05 λg or longer, the characteristics periodically changed (for each about 0.5 λg, for example) in accordance with the antenna length (total length of the above described route).

For example, a range near 0.70 λg is especially preferable in the effective ranges. That is, it is especially preferable that the length of the upper elements is in a range near 640 mm (L25G: 40 mm+L26G: 600 mm, and does not have the folded element).

Practical Example 2

The rear window glass 60 for the automobile (vehicle) was used to produce each automobile glass antenna of which a length (L25H+L26H (+L263+L264)) of the upper elements 25 and 26 is different according to the first embodiment illustrated in FIG. 3 and the ninth embodiment illustrated in FIG. 11. Here, for each different antenna length, frequency-antenna gain characteristics were measured to calculate average characteristics.

In this practical example, a length (L25H+L26H (+L263+L264)) of the upper elements in the glass antenna was changed in 16 ways from, 0 (no upper element), 145, 245, 345, 445, 545, 645, 745, 845, 945, 1045, 1145, 1245, 1345, 1445, to 1545 mm.

Here, based on each of these lengths, an antenna length (total length of the above described route) from the feed point 5 is converted to a wavelength where fractional shortening (shortening coefficient) k is 0.64, the center frequency of frequency band H, which is 92 MHz, has a wavelength of λ in the air, and the formula of λg=λ·k is established. The respective antenna lengths correspond to 0.40, 0.47, 0.52, 0.57, 0.61, 0.66, 0.71, 0.76, 0.81, 0.85, 0.90, 0.95, 1.00, 1.04, 1.09, and 1.14 λg.

Specifically, the antenna length was defined by the total length (L19+L21+L22+L25H+L26H (+L263+L264)) from "feed point" to "leading edge of element". A starting point of a graph in each of FIGS. 15 and 16 is 0.40 λg, which corresponds to 835 mm (L19: 5 mm+L21: 770 mm+L22: 60 mm).

In this practical example, the upper element was upwardly folded as illustrated in FIG. 11 when the upper element was extended. Dimensions in a case where the longest length of the upper elements (L25H+L26H+L263+L264) is 1545 mm in the measurements were as follows.

| | |
|---|---|
| L25H | 30 mm |
| L26H | 770 mm |
| L263 | 10 mm |
| L264 | 735 mm |

Figure 15:
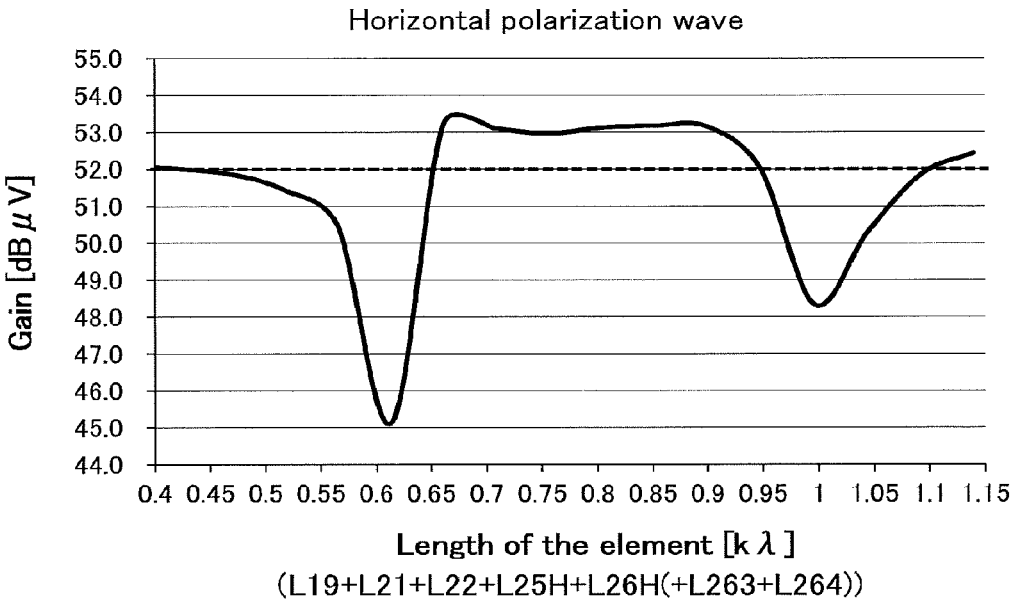
FIG. 15 is a graph illustrating average antenna gains of horizontally polarized waves in the entire frequency band of 76 MHz to 108 MHz when the length of the upper elements was changed in a direction illustrated in FIG. 11 in the configuration of FIG. 3 having the upper elements.
Figure 16:
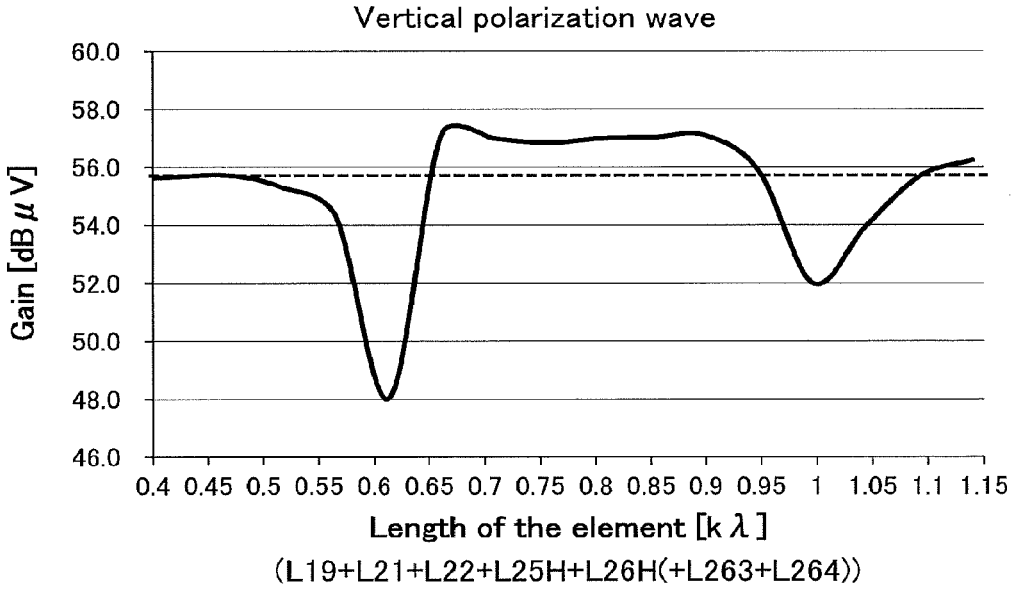
FIG. 16 is a graph illustrating average antenna gains of vertically polarized waves in the entire frequency band of 76 MHz to 108 MHz when the length of the upper elements was changed in the direction illustrated in FIG. 11 in the configuration of FIG. 3 having the upper elements.

FIG. 15 is a graph illustrating average antenna gains of the horizontally polarized waves in the entire frequency band of 76 MHz to 108 MHz when the length of the upper elements was changed in the upper direction illustrated in FIG. 11 in the configuration of FIG. 3 having the upper elements. Here, as illustrated in FIG. 11, the upper element was upwardly folded when the upper element was extended in this practical example.

FIG. 16 is a graph illustrating average antenna gains of the vertically polarized waves in the entire frequency band of 76 MHz to 108 MHz when the length of the upper elements was changed in the upper direction illustrated in FIG. 11 in the configuration of FIG. 3 having the upper elements.

It is proved from the graphs illustrated in FIGS. 15 and 16 that a range of from 0.65 λg to 0.95 λg is effective in comparison with a case (left end of graph) where the upper elements were not disposed.

Further, it is proved from right sides of the graphs that the antenna gain is improved when the length is 1.10 λg or longer. As illustrated in the graphs in FIGS. 15 and 16, because the gain was improved at least in the range of from 0.65 λg to 0.95 λg and in the range of 1.10 λg or longer, the characteristics periodically changed (for each about 0.5 λg, for example) in accordance with the antenna length (total length of the above described route).

For example, a range near 0.66 λg is especially preferable in the effective ranges. That is, it is especially preferable that the length of the upper elements is in a range near 540 mm (L25H: mm+L26H: 510 mm, and does not have the folded element).

Practical Example 3

The rear window glass 60 for the automobile (vehicle) was used to produce each automobile glass antenna of which a length (L25I+L26I+L265+L266) of the upper elements is different according to the tenth embodiment illustrated in FIG. 12. Here, for each different antenna length, frequency-antenna gain characteristics were measured to calculate average characteristics.

In this practical example, a length (L25I+L26I+L265+L266) of the upper elements in the glass antenna was changed in 15 ways from, 0 (no upper element), 45, 145, 245, 345, 445, 545, 645, 745, 845, 945, 1045, 1145, 1245, to 1345 mm.

Here, based on each of these lengths, an antenna length (total length of the above described route) from the feed point 5 is converted to a wavelength where fractional shortening k is 0.64, the center frequency of frequency band H, which is 92 MHz, has a wavelength of λ in the air, and the formula of λg=λ·k is established. The respective antenna lengths correspond to 0.40, 0.47, 0.52, 0.57, 0.61, 0.66, 0.71, 0.76, 0.81, 0.85, 0.90, 0.95, 1.00, 1.04, and 1.09 λg.

Specifically, the antenna length was defined by the total length (L19+L21+L22+D25+L25I+L26I+L265+L266) from "feed point" to "leading edge of element". A starting point of each two graphs is 835 mm (L19: 5 mm+L21: 770 mm+L22: 60 mm), which corresponds to 0.40 λg. Here, distance D25 is 100 mm. Thus, in a case where the antenna length exceeds 935 mm (835 mm+100 mm), distance D25 is included in the antenna length. For example, in a case of 0.47 λg, the length of the upper elements is 45 mm in the antenna length where the length to the starting point, which is 835 mm, and distance D25, which is 100 mm, are subtracted.

In this practical example, the upper element was downwardly folded as illustrated in FIG. 12 when the upper element was extended. Dimensions in a case where the longest length of the upper elements (L25I+L26I+L265+L266) is 1345 mm in the measurements were as follows.

| | |
|---|---|
| L25I | 40 mm |
| L26I | 670 mm |
| L265 | 10 mm |
| L266 | 625 mm |

Figure 17:
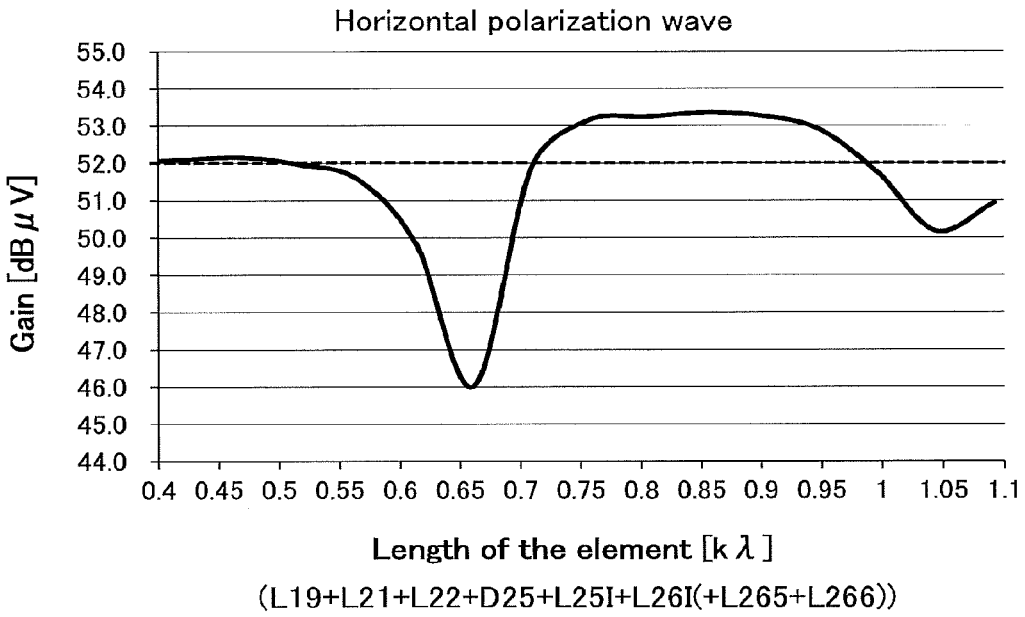
FIG. 17 is a graph illustrating average antenna gains of horizontally polarized waves in the entire frequency band of 76 MHz to 108 MHz when the length of the upper elements was changed in a configuration of FIG. 12 having a different starting point of the upper elements.

FIG. 17 is a graph illustrating average antenna gains of the horizontally polarized waves in the entire frequency band of 76 MHz to 108 MHz when the length of the upper elements was changed in the configuration of FIG. 12 having a different starting point of the upper elements. Here, as illustrated in FIG. 12, the upper element was downwardly folded when the upper element was extended in this practical example.

Figure 18:
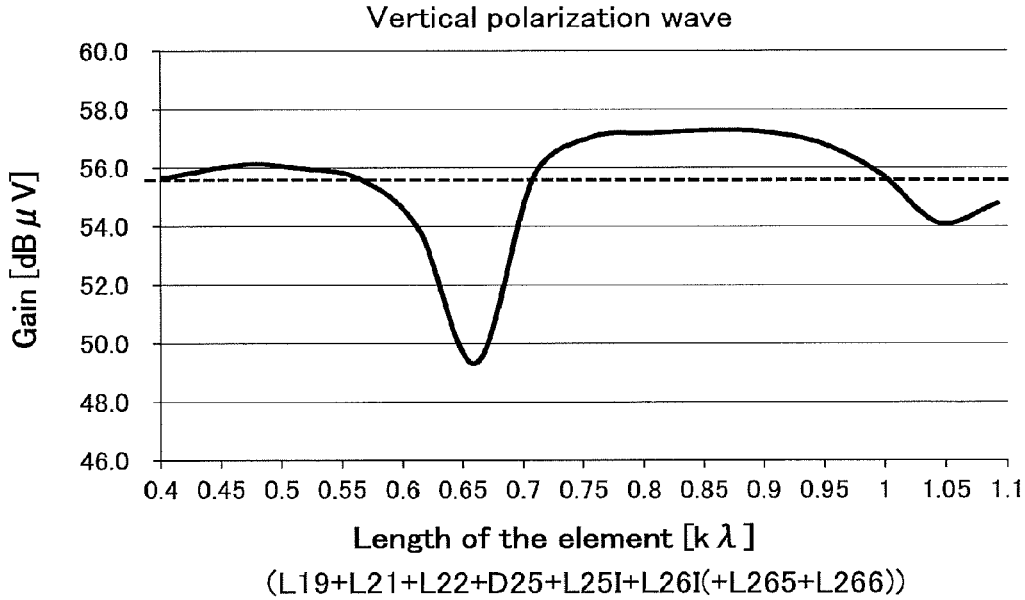
FIG. 18 is a graph illustrating average antenna gains of vertically polarized waves in the entire frequency band of 76 MHz to 108 MHz when the length of the upper elements was changed in the configuration of FIG. 12 having the different starting point of the upper elements.

FIG. 18 is a graph illustrating average antenna gains of the vertically polarized waves in the entire frequency band of 76 MHz to 108 MHz when the length of the upper elements was changed in the configuration of FIG. 12 having the different starting point of the upper elements.

It is proved from the graphs illustrated in FIGS. 17 and 18 that a range of from 0.4 λg to 0.55 λg and a range of from 0.70 λg to 1.00 λg are effective in comparison with a case (left end of graph) where the upper elements were not disposed. Here, because a position of the upper antenna elements moved to the feed point side for an amount of distance D25, the gain shifts from practical example 1 in the graphs and the preferable ranges for the gain are different.

As illustrated in the graphs in FIGS. 17 and 18, because the gain was improved at least in the range of from 0.4 λg to 0.55 λg and in the range of from 0.70 λg to 1.00 λg, the characteristics periodically changed (for each about 0.4 λg to 0.5 λg, for example) in accordance with the antenna length (total length of the above described route).

It is especially preferable that the length of the upper elements is in a range near 640 mm (L25I: 40 mm+L261: 600 mm, and does not have the folded element) in the effective ranges. That is, a range near 0.71 λg, which corresponds to the total length 740 mm of the upper elements and distance D25, is especially preferable as illustrated in FIGS. 17 and 18.

Figure 1:
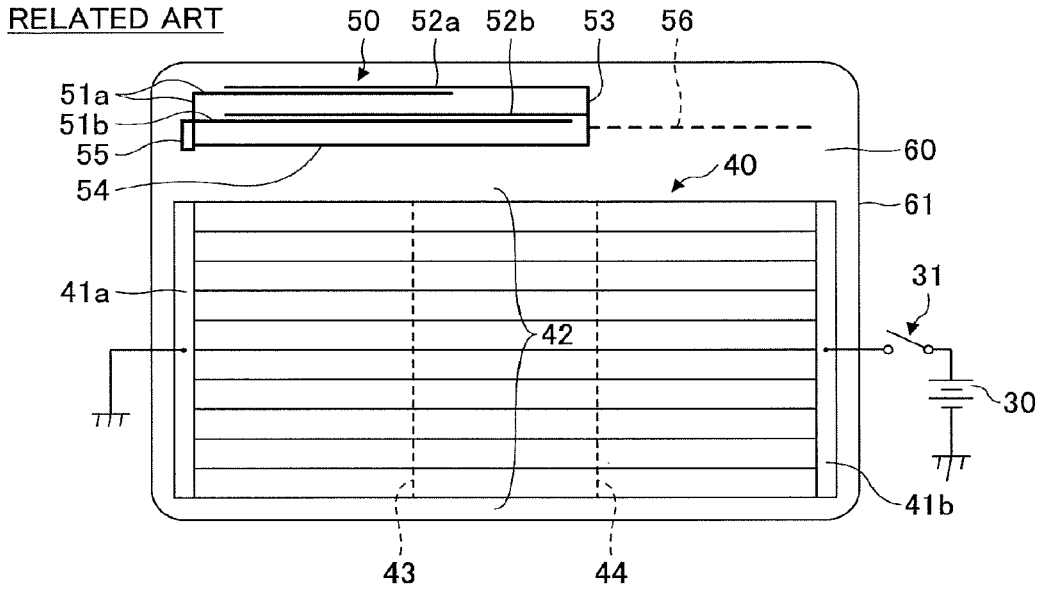
FIG. 1 is an entire plan view of a rear glass on which a glass antenna is disposed in the related art.

In this way, according to practical examples 1 to 3, it was proved that the gain was improved by adding the upper elements having the appropriate length in comparison with a configuration of a comparison example of FIG. 1.

Practical Example 4

The rear window glass 60 for the automobile (vehicle) was used to produce each glass antenna of which a length (L27+L28) of the lower elements 27 and 28 is different according to the second embodiment illustrated in FIG. 4. Here, for each different antenna length (total length of a predetermined route), frequency-antenna gain characteristics were measured to calculate average characteristics.

In this practical example, a length (L27+L28) of the lower elements in the glass antenna was changed in 8 ways from, 0 (no lower element), 30, 80, 130, 240, 440, 540 to 640 mm.

Here, based on each of these lengths, an antenna length (total length of the above described route) from the feed point 5 is converted to a wavelength where fractional shortening (shortening coefficient) k is 0.64, the center frequency of frequency band H, which is 92 MHz, has a wavelength of λ in the air, and the formula of λg=λ·k is established. The respective antenna lengths correspond to 0.36, 0.39, 0.41, 0.43, 0.49, 0.58, 0.63, and 0.68 λg.

Specifically, the antenna length was defined by the length (L19+L21+L27+L28) from "feed point" to "leading edge of element". A starting point of a graph in each of FIGS. 19 and 20 is 0.36 λg, which corresponds to 775 mm (L19: 5 mm+L21: 770 mm).

Figure 19:
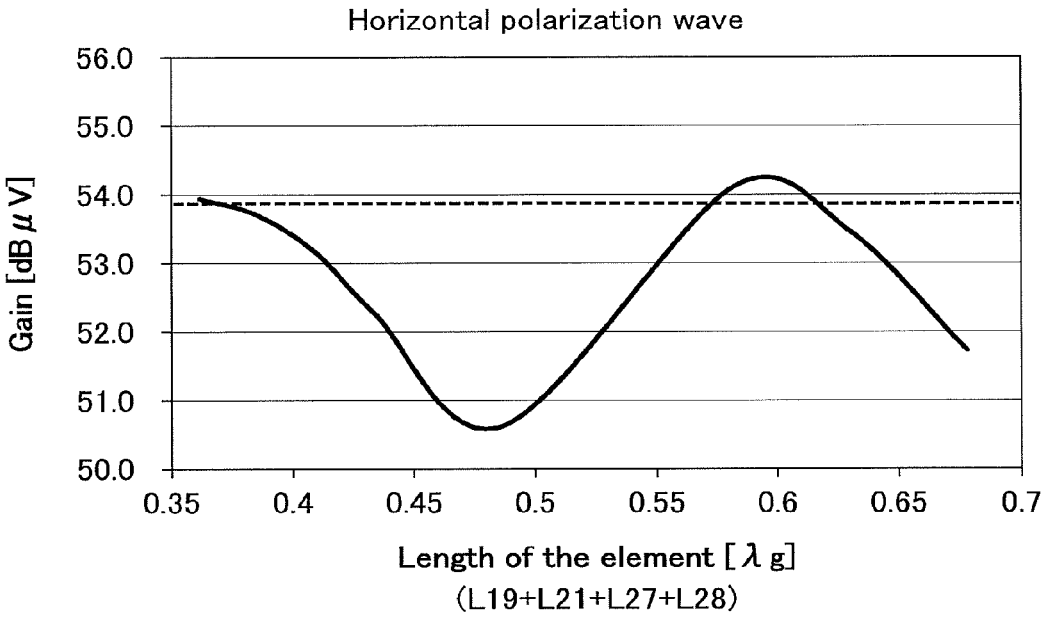
FIG. 19 is a graph illustrating average antenna gains of horizontally polarized waves in the entire frequency band of 76 MHz to 108 MHz when a length of the lower elements was changed in a configuration of the second embodiment of FIG. 4.

FIG. 19 is a graph illustrating average antenna gains of the horizontally polarized waves in the entire frequency band of 76 MHz to 108 MHz when the length of the lower elements was changed in the configuration of the second embodiment of FIG. 4.

Figure 20:
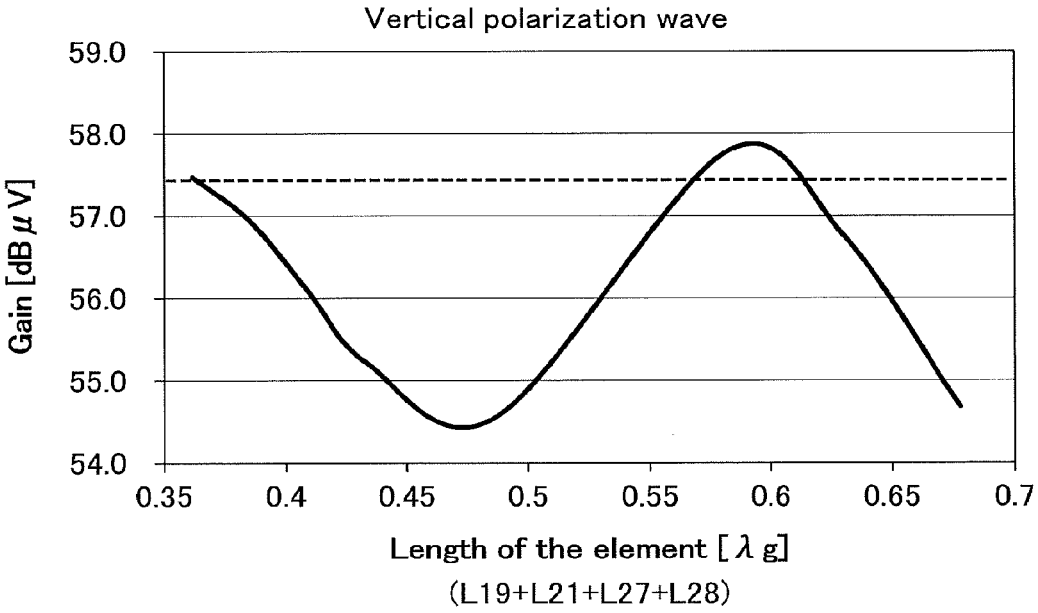
FIG. 20 is a graph illustrating average antenna gains of vertically polarized waves in the entire frequency band of 76 MHz to 108 MHz when the length of the lower elements was changed in the configuration of FIG. 4.

FIG. 20 is a graph illustrating average antenna gains of the vertically polarized waves in the entire frequency band of 76 MHz to 108 MHz when the length of the lower elements was changed in the configuration of FIG. 4.

It is proved from the graphs illustrated in FIGS. 19 and 20 that the gain is improved by setting the conductor length of the lower elements to be a total length in a range of from 0.57 λg to 0.62 λg in comparison with a case (left end of graph) where the lower elements were not disposed.

Further, because the gain transitions (changes) periodically as a trigonometric function as illustrated in the graphs of FIGS. 19 and 20, it can be assumed that the gain increases again in frequency bands of 0.7 λg or more.

A range near 0.59 λg is especially preferable in the effective range. That is, it is especially preferable that the length of the lower elements is in a range near 460 mm (L27: 40 mm+L28: 420 mm).

In this way, according to practical example 4, it was proved that the gain was improved by adding the lower elements having the appropriate length in comparison with the configuration of the comparison example of FIG. 1.

Practical Example 5

The rear window glass 60 for the automobile (vehicle) was used to produce each automobile glass antenna where a length (L27+L28) of the lower elements 27 and 28 is fixed and a length (L25+L26) of the upper elements 25 and 26 is different according to the third embodiment illustrated in FIG. 5. Here, for each different antenna length, frequency-antenna gain characteristics were measured to calculate average characteristics.

In the third embodiment, the dimension L27 of the lower element 27 was fixed to 40 mm, and the dimension L28 of the lower element 28 was fixed to be 420 mm. Other dimensions of the configuration are similar to the dimensions of practical example 1.

Similar to practical example 1, a length (L25+L26) of the upper elements in the glass antenna was changed in 16 ways from, 0 (no upper element), 145, 245, 345, 445, 545, 645, 745, 845, 945, 1045, 1145, 1245, 1345, 1445, to 1545 mm in this practical example. It should be noted that the upper element was downwardly folded as illustrated in FIG. 10, when the upper element was extended in this practical example.

Here, based on each of these lengths, an antenna length (total length of the above described route) from the feed point 5 is converted to a wavelength where fractional shortening (shortening coefficient) k is 0.64, the center frequency of frequency band H, which is 92 MHz, has a wavelength of λ in the air, and the formula of λg=λ·k is established. The respective antenna lengths correspond to 0.40, 0.47, 0.52, 0.57, 0.61, 0.66, 0.71, 0.76, 0.81, 0.85, 0.90, 0.95, 1.00, 1.04, 1.09, and 1.14 λg.

Specifically, the antenna length was defined by the total length (L19+L21+L22+L25+L26) from "feed point" to "leading edge of element". A starting point of a graph in each of FIGS. 21 and 22 is 0.40 λg, which corresponds to 835 mm (L19: 5 mm+L21: 770 mm+L22: 60 mm).

Figure 21:
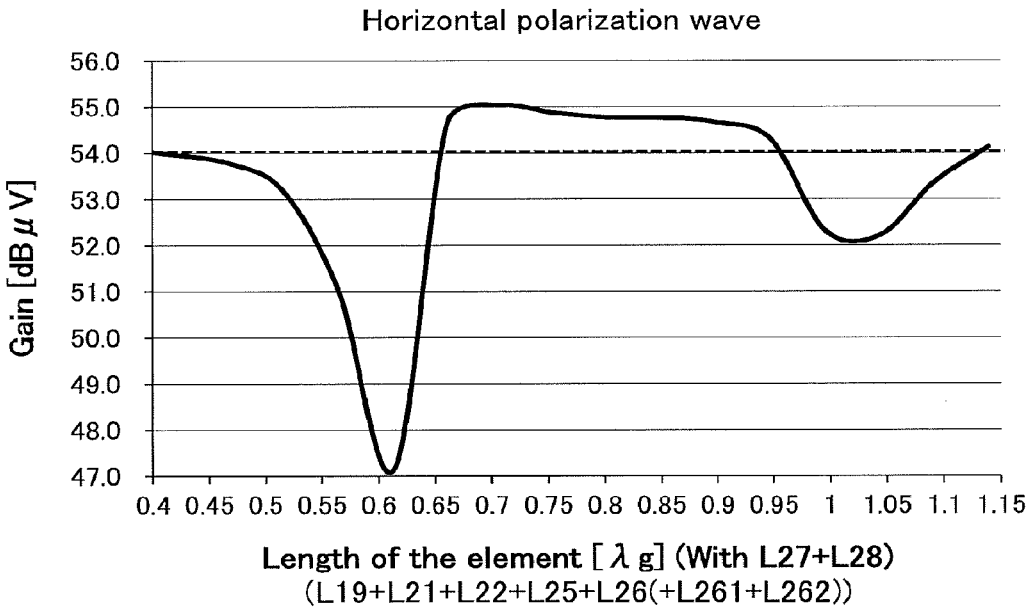
FIG. 21 is a graph illustrating average antenna gains of horizontally polarized waves in the entire frequency band of 76 MHz to 108 MHz when the length of the upper elements was changed in a configuration of FIG. 5 having the upper elements and the lower elements.

FIG. 21 is a graph illustrating average antenna gains of the horizontally polarized waves in the entire frequency band of 76 MHz to 108 MHz when the length of the upper elements was changed in the third embodiment where the length of the lower elements was fixed to be the appropriate length.

Figure 22:
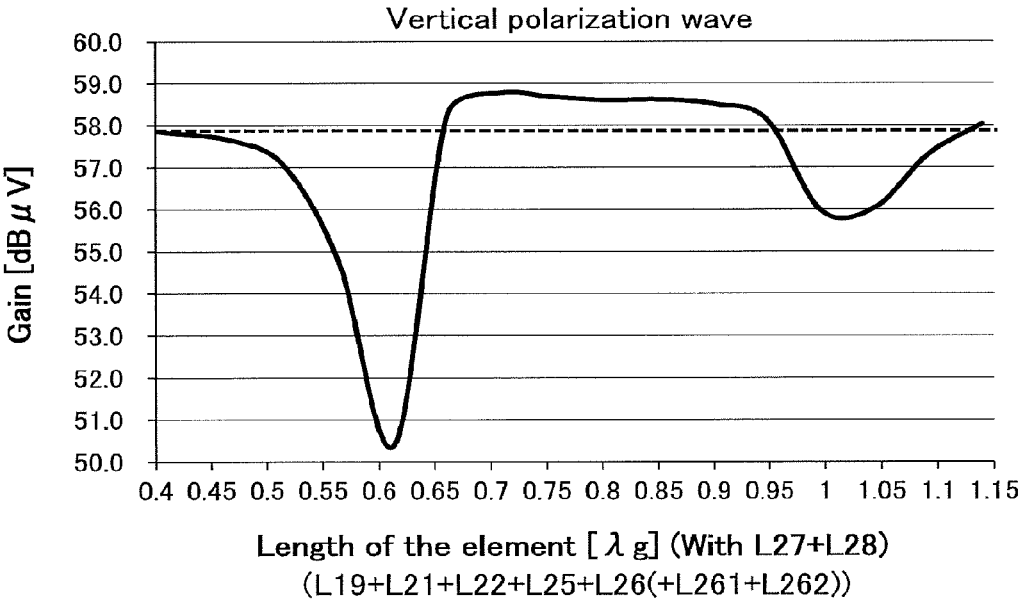
FIG. 22 is a graph illustrating average antenna gains of vertically polarized waves in the entire frequency band of 76 MHz to 108 MHz when the length of the upper elements was changed in a configuration of FIG. 5 having the upper elements and the lower elements.

FIG. 22 is a graph illustrating average antenna gains of the vertically polarized waves in the entire frequency band of 76 MHz to 108 MHz when the length of the upper elements was changed in the third embodiment where the length of the lower elements was fixed to be the appropriate length.

It is proved from the graphs illustrated in FIGS. 21 and 22 that a range of from 0.65 λg to 0.95 λg is effective in comparison with a case (left end of graph) where the upper elements were not disposed.

Further, it is proved from right sides of the graphs that the antenna gain is improved when the length is 1.15 λg or longer. As illustrated in the graphs in FIGS. 21 and 22, because the gain was improved at least in the range of from 0.65 λg to 0.95 λg and in the range of 1.15 λg or longer, the characteristics periodically changed (for each about 0.5 λg, for example) in accordance with the antenna length (total length of the above described route).

A range near 0.70 λg is especially preferable in the effective ranges. That is, it is especially preferable that the length of the upper elements is in a range near 640 mm (L25: 40 mm+L26: 600 mm).

According to practical example 5, it was proved that the gain was improved by adding the upper elements having the appropriate length to the configuration of the second embodiment in comparison with practical example 4.

Also, it was proved by comparing practical example 5 with practical example 1 that the gain is similarly changed depending on the length of the added upper elements even when the lower elements are added.

Practical Example 6

The rear window glass 60 for the automobile (vehicle) was used to produce the glass antenna according to the first embodiment of FIG. 3 and the glass antenna of the comparison example of FIG. 1. Then, frequency-antenna gain characteristics were measured in the first embodiment and the comparison example.

Dimensions of the comparison example are almost same as the dimensions of the first embodiment. However, the comparison example differs from the first embodiment in that the upper elements 25 and 26 are not disposed. Also, the comparison example differs from the first embodiment in that the feed point 55 is located above the transverse element 21 for feed connection illustrated in FIG. 2 and a vertical length of an element 51*a*, which corresponds to the vertical element 11 for feed connection of FIG. 2, is 60 mm, which is shorter than the vertical element 11 for feed connection.

In consideration of the result of practical example 1, the dimension L25 of the upper element 25 was set to be 40 mm and the dimension L26 of the upper element 26 was set to be 600 mm in this practical example. Other dimensions of this practical example are similar to the dimensions of practical example 1.

Figure 23:
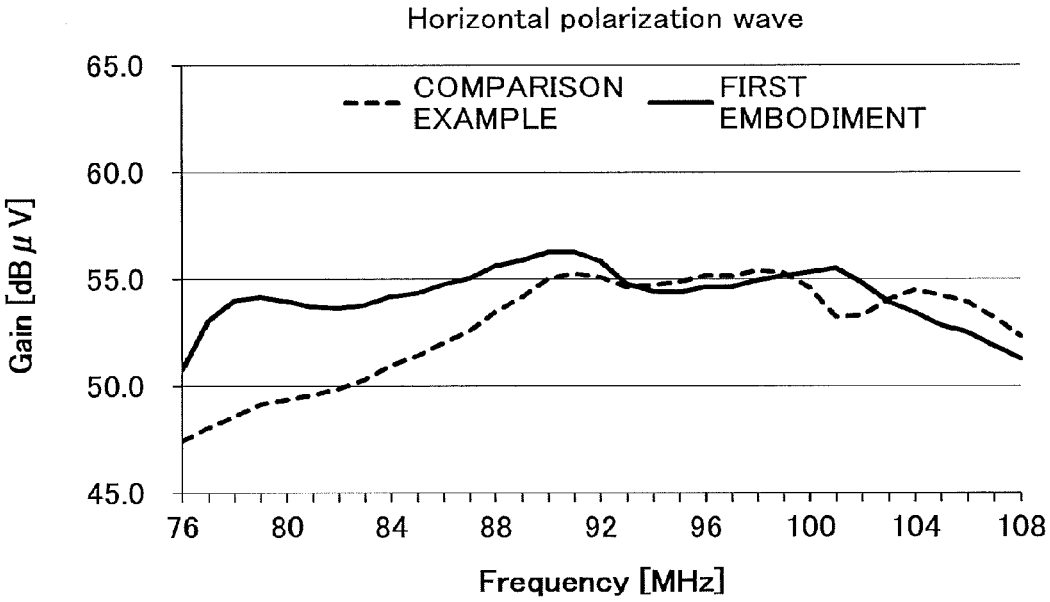
FIG. 23 is a graph comparing the configuration having the upper elements illustrated in FIG. 3 with a comparison example and illustrating antenna gains of horizontally polarized waves in the frequency band of 76 MHz to 108 MHz.

FIG. 23 is a graph comparing the configuration having the upper elements illustrated in FIG. 3 with the comparison example and illustrating antenna gains of the horizontally polarized waves in the frequency band of 76 MHz to 108 MHz.

Figure 24:
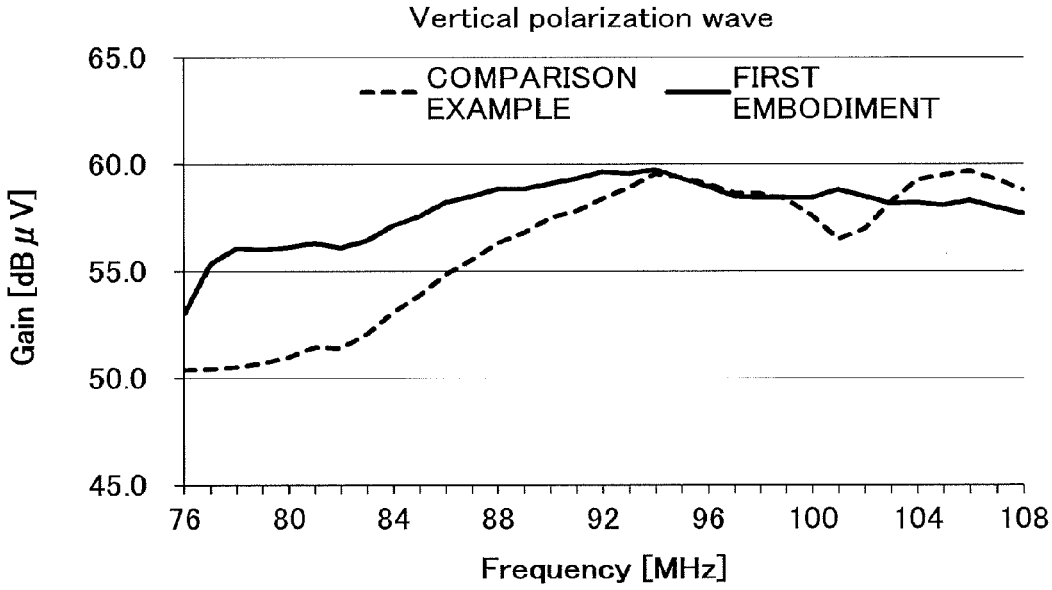
FIG. 24 is a graph comparing the configuration having the upper elements illustrated in FIG. 3 with the comparison example and illustrating antenna gains of vertically polarized waves in the frequency band of 76 MHz to 108 MHz.

FIG. 24 is a graph comparing the configuration having the upper elements illustrated in FIG. 3 with the comparison example and illustrating antenna gains of the vertically polarized waves in the frequency band of 76 MHz to 108 MHz.

It is proved from the graphs illustrated in FIGS. 23 and 24 that the antenna gain of the first embodiment increases with respect to the antenna gain of the comparison example in a band from 76 MHz to 96 MHz, where the gain is low, and in a band from 100 MHz to 104 MHz. Decline of the antenna gain is resolved in the band from 100 MHz to 104 MHz.

In this way, it becomes possible to cover not only the US/European FM broadcast band (88 MHz to 108 MHz) but also the Japanese FM band (76 MHz to 90 MHz), for example. That is, it becomes possible to deal with a wide band.

As for the horizontally polarized waves illustrated in FIG. 23, the average gain of the entire frequency band of the configuration of the comparison example was 53.1 dBμV and the average gain of the entire frequency band of the configuration having the upper elements was 54.1 dBμV.

As for the vertically polarized waves illustrated in FIG. 24, the average gain of the entire frequency band of the configuration of the comparison example was 56.6 dBμV and the average gain of the entire frequency band of the configuration having the upper elements was 58.0 dBμV.

Thus, relative to the comparison example, the characteristics of the antenna in the entire band were improved in the first embodiment by disposing the upper elements.

Practical Example 7

The rear window glass 60 for the automobile (vehicle) was used to produce the glass antenna according to the second embodiment of FIG. 4 and the glass antenna of the comparison example of FIG. 1. Then, frequency-antenna gain characteristics were measured in the second embodiment and the comparison example. In consideration of the result of practical example 1, the dimension L27 of the lower element 27 was set to be 40 mm and the dimension L28 of the lower element 28 was set to be 420 mm in this practical example. Other dimensions of this practical example are similar to the dimensions of practical example 1.

Figure 25:
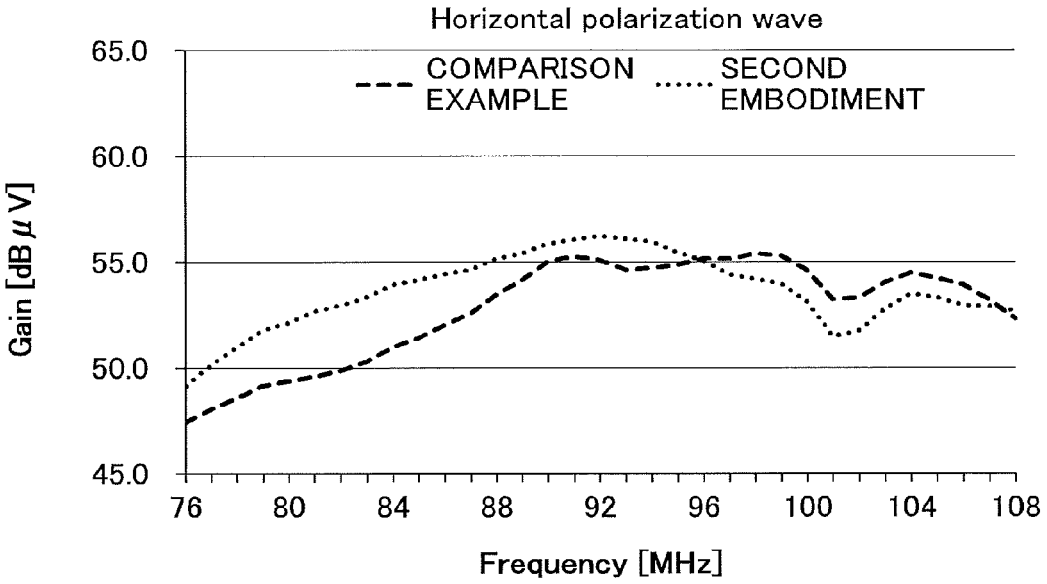
FIG. 25 is a graph comparing the configuration having the lower elements illustrated in FIG. 4 with the comparison example and illustrating antenna gains of horizontally polarized waves in the frequency band of 76 MHz to 108 MHz.

FIG. 25 is a graph comparing the configuration having the lower elements illustrated in FIG. 4 with the comparison example and illustrating antenna gains of the horizontally polarized waves in the frequency band of 76 MHz to 108 MHz.

Figure 26:
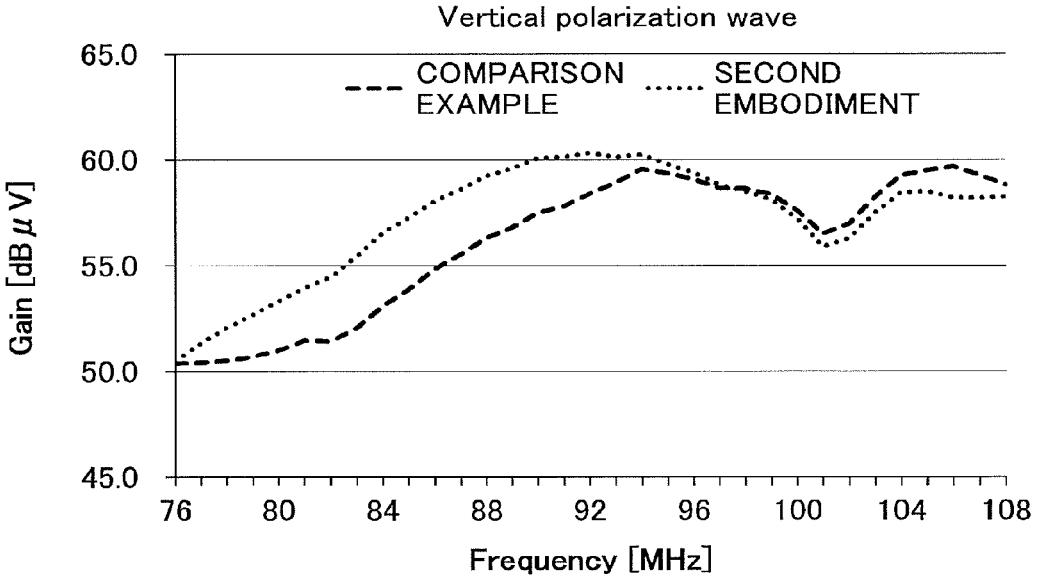
FIG. 26 is a graph comparing the configuration having the lower elements with the comparison example and illustrating antenna gains of vertically polarized waves in the frequency band of 76 MHz to 108 MHz.

FIG. 26 is a graph comparing the configuration having the lower elements with the comparison example and illustrating antenna gains of the vertically polarized waves in the frequency band of 76 MHz to 108 MHz.

It is proved from the graphs illustrated in FIGS. 25 and 26 that the antenna gain of the second embodiment increases in a frequency band from 76 MHz to 96 MHz, where the gain is low, and in a frequency band from 104 MHz to 108 MHz. In this way, it becomes possible to cover not only the US/European FM broadcast band (88 MHz to 108 MHz) but also the Japanese FM band (76 MHz to 90 MHz), for example. That is, it becomes possible to deal with the wide band.

As for the horizontally polarized waves illustrated in FIG. 25, the average gain of the entire frequency band of the configuration of the comparison example was 53.1 dBμV and the average gain of the entire frequency band of the configuration having the lower elements was 53.8 dBμV.

As for the vertically polarized waves illustrated in FIG. 26, the average gain of the entire frequency band of the configuration of the comparison example was 56.6 dBμV and the average gain of the entire frequency band of the configuration having the lower elements was 57.6 dBμV.

Thus, relative to the comparison example, the characteristics of the antenna in the entire band were improved in the second embodiment by disposing the lower elements.

Practical Example 8

The rear window glass 60 for the automobile (vehicle) was used to produce the glass antenna according to the third embodiment of FIG. 5 and the glass antenna according to the second embodiment of FIG. 4. Then, frequency-antenna gain characteristics were measured in the third embodiment and the second embodiment. Dimensions of the configuration in the third embodiment are similar to the above described dimensions of practical examples 6 and 7.

Although the glass antenna having the lower elements were compared with the glass antenna 50 of the comparison example illustrated in FIG. 1 as described above, the effect of improving the gain was confirmed by adding the upper elements having a predetermined length.

Figure 27:
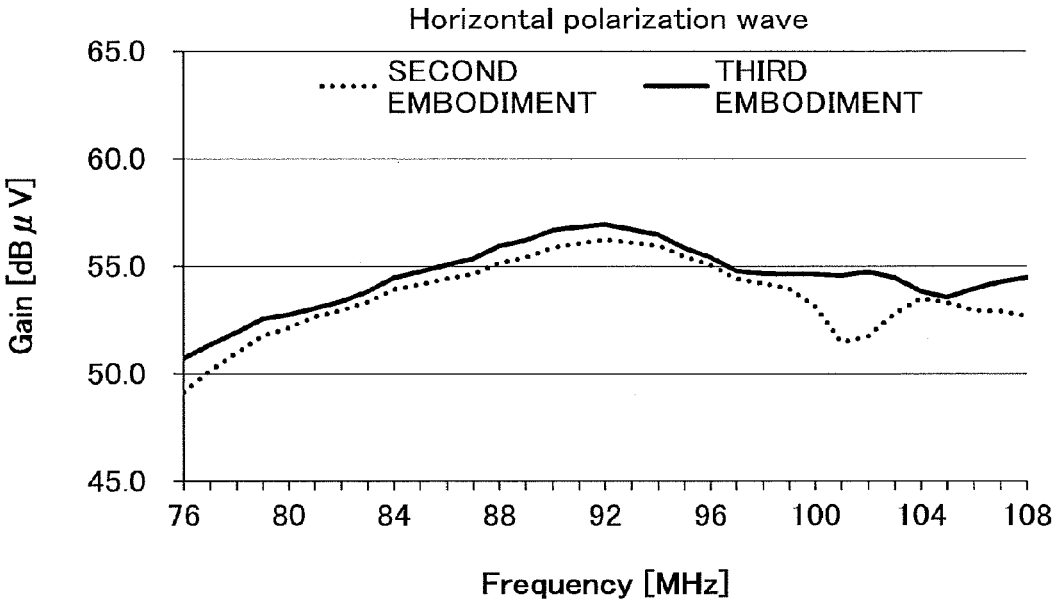
FIG. 27 is a graph comparing the configuration having the upper elements and the lower elements illustrated in FIG. 5 with the configuration having the lower elements illustrated in FIG. 4 and illustrating antenna gains of horizontally polarized waves in the frequency band of 76 MHz to 108 MHz.

FIG. 27 is a graph comparing the configuration having the upper elements and the lower elements illustrated in FIG. 5 with the configuration having the lower elements illustrated in FIG. 4 and illustrating antenna gains of the horizontally polarized waves in the frequency band of 76 MHz to 108 MHz.

Figure 28:
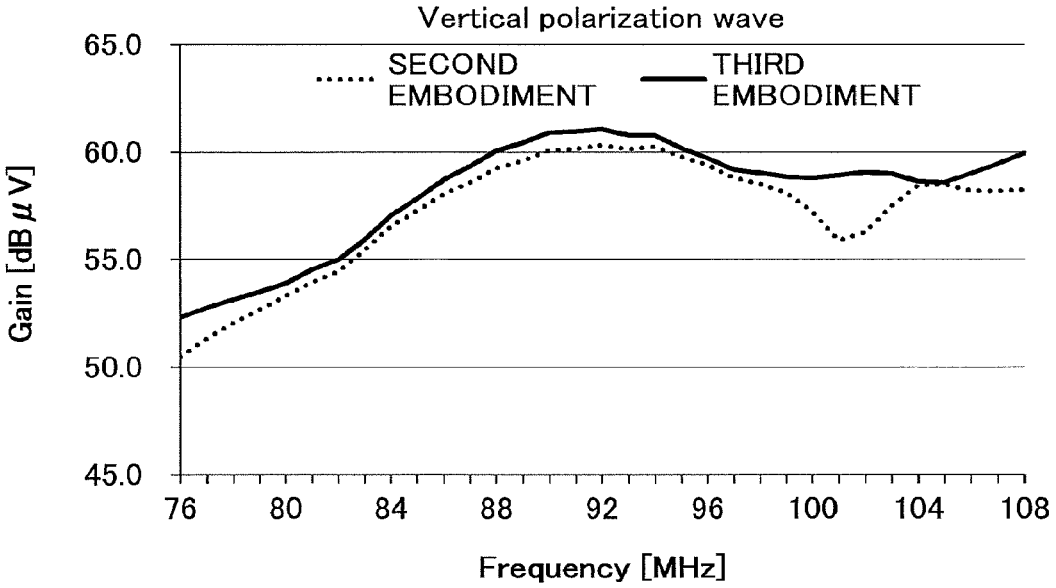
FIG. 28 is a graph comparing the configuration having the upper elements and the lower elements illustrated in FIG. 5 with the configuration having the lower elements illustrated in FIG. 4 and illustrating antenna gains of vertically polarized waves in the frequency band of 76 MHz to 108 MHz.

FIG. 28 is a graph comparing the configuration having the upper elements and the lower elements illustrated in FIG. 5 with the configuration having the lower elements illustrated in FIG. 4 and illustrating antenna gains of the vertically polarized waves in the frequency band of 76 MHz to 108 MHz.

It is proved from the graphs illustrated in FIGS. 27 and 28 that, in the band from 100 MHz to 104 MHz where the gain declines, the decline is resolved and the gain increases in the third embodiment. In this way, it becomes possible to cover not only the Japanese FM band (76 MHz to 90 MHz) but also the US/European FM broadcast band (88 MHz to 108 MHz), for example. That is, it becomes possible to deal with the wide band.

As for the horizontally polarized waves illustrated in FIG. 27, the average gain of the entire frequency band of the configuration of the second embodiment illustrated in FIG. 4 was 53.8 dBμV and the average gain of the entire frequency band of the configuration of the third embodiment illustrated in FIG. 5 was 54.6 dBμV.

As for the vertically polarized waves illustrated in FIG. 28, the average gain of the entire frequency band of the configuration of the second embodiment illustrated in FIG. 4 was 57.6 dBμV and the average gain of the entire frequency band of the configuration of the third embodiment illustrated in FIG. 5 was 58.5 dBμV.

As described above, it was proved by comparing the third embodiment having both the upper elements and the lower elements with the second embodiment having only the lower elements that the characteristics of the antenna in the entire band are improved by disposing both the upper elements and the lower elements having an appropriate length.

Practical Example 9

The rear window glass 60 for the automobile (vehicle) was used to produce the glass antenna according to the fifth embodiment of FIG. 7 and the glass antenna according to the second embodiment of FIG. 4. Then, frequency-antenna gain characteristics were measured in the fifth embodiment and the second embodiment.

The dimension L8 of the loom forming element 8 was set to be 40 mm and dimension L9 of the loom forming element 9 was set to be 40 mm in the fifth embodiment. Other dimensions of the configuration in the fifth embodiment are similar to the above described dimensions of practical examples 1, 6, and 7.

Figure 29:
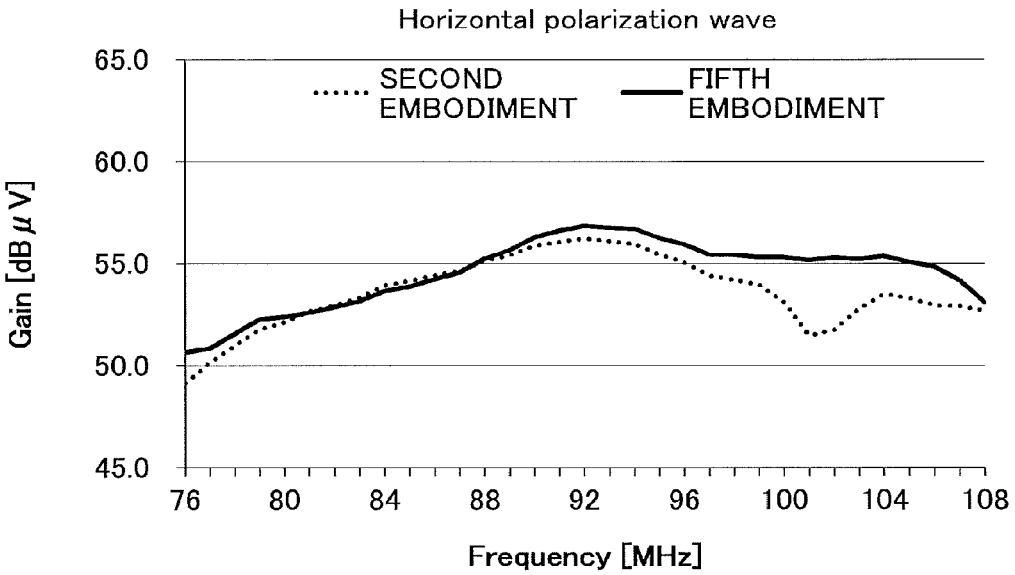
FIG. 29 is a graph comparing a configuration having the lower elements and loop forming elements illustrated in FIG. 7 with the configuration having the lower elements illustrated in FIG. 4 and illustrating antenna gains of horizontally polarized waves in the frequency band of 76 MHz to 108 MHz.

FIG. 29 is a graph comparing the configuration having the lower elements and the loop forming elements illustrated in FIG. 7 with the configuration having the lower elements illustrated in FIG. 4 and illustrating antenna gains of the horizontally polarized waves in the frequency band of 76 MHz to 108 MHz.

Figure 30:
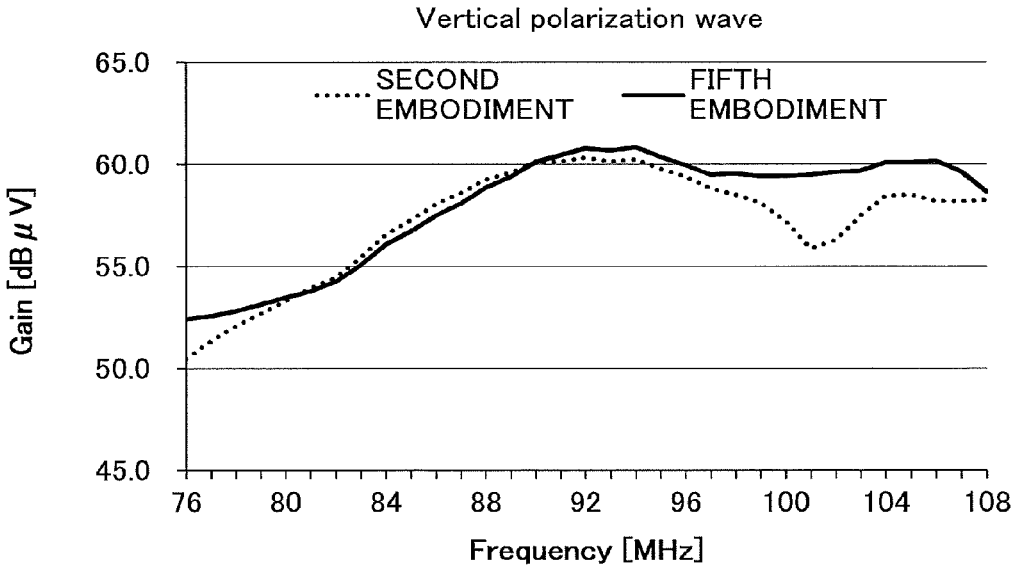
FIG. 30 is a graph comparing the configuration having the lower elements and the loop forming elements illustrated in FIG. 7 with the configuration having the lower elements illustrated in FIG. 4 and illustrating antenna gains of vertically polarized waves in the frequency band of 76 MHz to 108 MHz.

FIG. 30 is a graph comparing the configuration having the lower elements and the loop forming elements illustrated in FIG. 7 with the configuration having the lower elements illustrated in FIG. 4 and illustrating antenna gains of the vertically polarized waves in the frequency band of 76 MHz to 108 MHz.

It is proved from the graphs illustrated in FIGS. 29 and 30 that, in the band from 100 MHz to 104 MHz where the gain declines and in the band from 104 MHz to 108 MHz, the decline is resolved and the gain increases in the fifth embodiment. In this way, it becomes possible to cover not only the Japanese FM band (76 MHz to 90 MHz) but also the US/European FM broadcast band (88 MHz to 108 MHz), for example. That is, it becomes possible to deal with the wide band.

As for the horizontally polarized waves illustrated in FIG. 29, the average gain of the entire frequency band of the configuration of the second embodiment illustrated in FIG. 4 was 53.8 dBμV and the average gain of the entire frequency band of the configuration of the fifth embodiment illustrated in FIG. 7 was 54.7 dBμV.

As for the vertically polarized waves illustrated in FIG. 30, the average gain of the entire frequency band of the configuration of the second embodiment illustrated in FIG. 4 was 57.6 dBμV and the average gain of the entire frequency band of the configuration of the fifth embodiment illustrated in FIG. 7 was 58.4 dBμV.

As described above, it was proved by comparing the fifth embodiment having both the lower elements and the loop forming elements with the second embodiment having only the lower elements that the characteristics of the antenna in the entire band are improved by disposing both the lower elements and the loop forming elements.

Practical Example 10

The rear window glass 60 for the automobile (vehicle) was used to produce the glass antenna according to the eight embodiment of FIG. 8 and the glass antenna of the comparison example of FIG. 1. Then, frequency-antenna gain characteristics were measured in the sixth embodiment and the comparison example.

Dimensions of the sixth embodiment are determined with reference to the above described dimensions of practical example 1, 6, 7, and 9.

Figure 31:
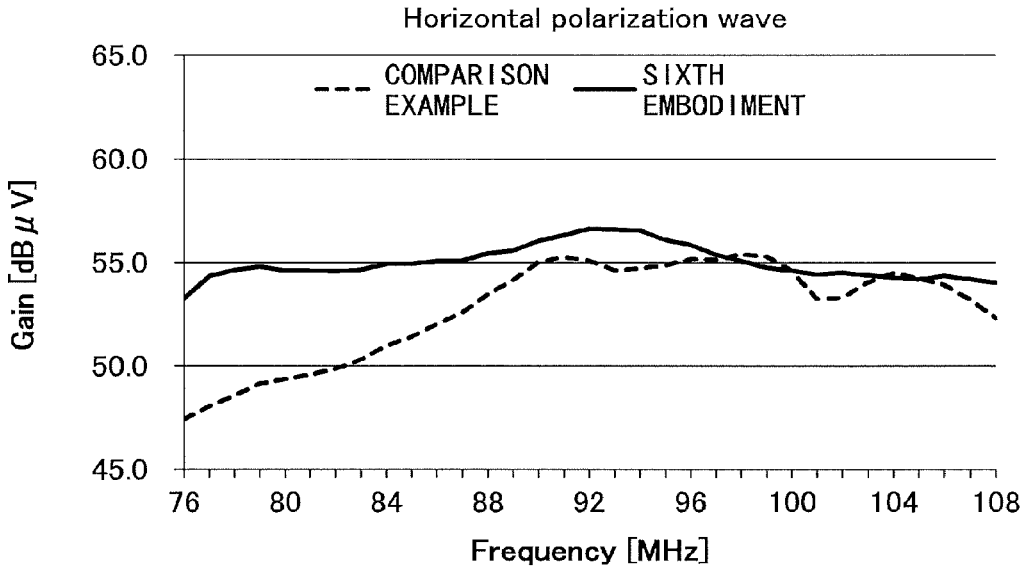
FIG. 31 is a graph comparing the configuration having the upper elements, the lower elements, and the loop forming elements illustrated in FIG. 8 with the configuration of the comparison example and illustrating antenna gains of horizontally polarized waves in the frequency band of 76 MHz to 108 MHz.

FIG. 31 is a graph comparing the configuration having the upper elements, the lower elements, and the loop forming elements illustrated in FIG. 8 with the configuration of the comparison example and illustrating antenna gains of the horizontally polarized waves in the frequency band of 76 MHz to 108 MHz.

Figure 32:
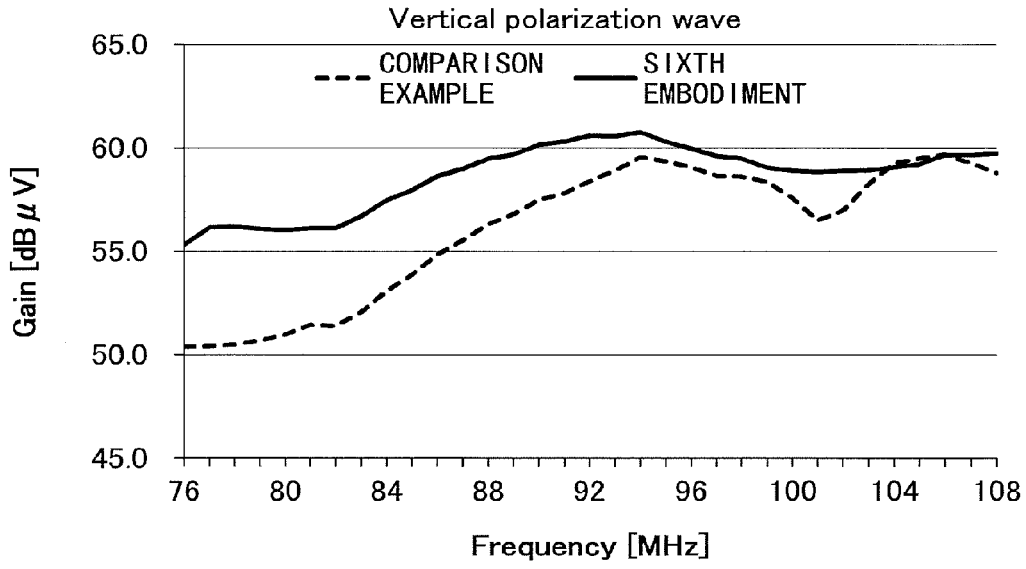
FIG. 32 is a graph comparing the configuration having the upper elements, the lower elements, and the loop forming elements illustrated in FIG. 8 with the configuration of the comparison example and illustrating antenna gains of vertically polarized waves in the frequency band of 76 MHz to 108 MHz.

FIG. 32 is a graph comparing the configuration having the upper elements, the lower elements, and the loop forming elements illustrated in FIG. 8 with the configuration of the comparison example and illustrating antenna gains of the vertically polarized waves in the frequency band of 76 MHz to 108 MHz.

It is proved from the graphs illustrated in FIGS. 31 and 32 that the decline of the gain is resolved and the gain increases in the sixth embodiment in the band from 100 MHz to 104 MHz where the antenna gain declines, and the antenna gain increases in the sixth embodiment in the band from 76 MHz to 96 MHz where the antenna gain is low. In this way, it becomes possible to sufficiently cover both the Japanese FM band (76 MHz to 90 MHz) and the US/European FM broadcast band (88 MHz to 108 MHz), for example. That is, it becomes possible to deal with the wide frequency band.

As for the horizontally polarized waves illustrated in FIG. 31, the average gain of the entire frequency band of the configuration of the comparison example was 53.1 dBμV and the average gain of the entire frequency band of the configuration of the sixth embodiment in FIG. 8 was 55.0 dBμV.

As for the vertically polarized waves illustrated in FIG. 32, the average gain of the entire frequency band of the configuration of the comparison example was 56.6 dBμV and the average gain of the entire frequency band of the configuration of the sixth embodiment in FIG. 8 was 58.8 dBμV.

The gain and the frequency characteristics are totally improved for both the horizontally polarized waves and the vertically polarized waves by disposing the upper elements, the lower elements, and the loop forming elements in comparison with the configuration of the comparison example illustrated in FIG. 1.

Table 1 illustrates the antenna gains of the horizontally polarized waves (horizontal polarization waves) of practical examples 6 to 10. Table 2 illustrates the antenna gains of the vertically polarized waves (vertical polarization waves) of practical examples 6 to 10.

TABLE 1

ANTENNA GAIN LIST (HORIZONTAL POLARIZATION WAVE)

[dB μV]

| FREQUENCY [MHz] | COMPARISON EXAMPLE | FIRST EMBODIMENT (UPPER ELEMENT) | SECOND EMBODIMENT (LOWER ELEMENT) | THIRD EMBODIMENT (UPPER ELEMENT AND LOWER ELEMENT) | FIFTH EMBODIMENT (LOWER ELEMENT AND LOOP FORMING ELEMENT) | SIXTH EMBODIMENT (UPPER ELEMENT, LOWER ELEMENT, AND LOOP FORMING ELEMENT) |
|---|---|---|---|---|---|---|
| 76 | 47.4 | 50.8 | 49.2 | 50.7 | 50.7 | 53.3 |
| 77 | 48.1 | 53.1 | 50.2 | 51.4 | 50.9 | 54.3 |
| 78 | 48.6 | 54.0 | 51.0 | 51.9 | 51.6 | 54.6 |
| 79 | 49.2 | 54.2 | 51.8 | 52.6 | 52.3 | 54.8 |
| 80 | 49.4 | 54.0 | 52.1 | 52.8 | 52.4 | 54.6 |
| 81 | 49.6 | 53.7 | 52.7 | 53.0 | 52.6 | 54.6 |
| 82 | 49.9 | 53.6 | 53.0 | 53.4 | 52.9 | 54.6 |
| 83 | 50.3 | 53.8 | 53.3 | 53.8 | 53.2 | 54.7 |
| 84 | 51.0 | 54.2 | 53.9 | 54.5 | 53.7 | 54.9 |
| 85 | 51.4 | 54.3 | 54.2 | 54.8 | 53.9 | 54.9 |
| 86 | 52.0 | 54.8 | 54.4 | 55.1 | 54.2 | 55.1 |
| 87 | 52.6 | 55.1 | 54.6 | 55.4 | 54.6 | 55.1 |
| 88 | 53.5 | 55.6 | 55.2 | 55.9 | 55.2 | 55.5 |
| 89 | 54.2 | 55.9 | 55.4 | 56.2 | 55.7 | 55.6 |
| 90 | 55.0 | 56.3 | 55.9 | 56.7 | 56.3 | 56.0 |
| 91 | 55.3 | 56.3 | 56.1 | 56.8 | 56.6 | 56.3 |
| 92 | 55.1 | 55.8 | 56.2 | 57.0 | 56.9 | 56.6 |
| 93 | 54.6 | 54.8 | 56.1 | 56.7 | 56.8 | 56.6 |
| 94 | 54.7 | 54.4 | 56.0 | 56.5 | 56.7 | 56.5 |
| 95 | 54.9 | 54.4 | 55.5 | 55.9 | 56.3 | 56.1 |
| 96 | 55.2 | 54.6 | 55.1 | 55.4 | 55.9 | 55.9 |
| 97 | 55.1 | 54.6 | 54.4 | 54.8 | 55.5 | 55.4 |
| 98 | 55.4 | 54.9 | 54.2 | 54.7 | 55.4 | 55.1 |
| 99 | 55.3 | 55.2 | 54.0 | 54.6 | 55.3 | 54.8 |
| 100 | 54.6 | 55.3 | 53.1 | 54.6 | 55.3 | 54.6 |
| 101 | 53.2 | 55.5 | 51.5 | 54.6 | 55.2 | 54.4 |
| 102 | 53.3 | 54.8 | 51.7 | 54.7 | 55.3 | 54.5 |
| 103 | 54.0 | 53.9 | 52.8 | 54.5 | 55.2 | 54.4 |
| 104 | 54.5 | 53.5 | 53.5 | 53.8 | 55.4 | 54.3 |
| 105 | 54.2 | 52.8 | 53.3 | 53.6 | 55.1 | 54.2 |
| 106 | 53.9 | 52.5 | 52.9 | 53.9 | 54.9 | 54.4 |
| 107 | 53.2 | 51.9 | 52.9 | 54.3 | 54.2 | 54.2 |
| 108 | 52.3 | 51.3 | 52.7 | 54.5 | 53.1 | 54.0 |
| AVERAGE | 53.1 | 54.1 | 53.8 | 54.6 | 54.7 | 55.0 |

TABLE 2

ANTENNA GAIN LIST (VERTICAL POLARIZATION WAVE)

[dB μV]

| FREQUENCY [MHz] | COMPARISON EXAMPLE | FIRST EMBODIMENT (UPPER ELEMENT) | SECOND EMBODIMENT (LOWER ELEMENT) | THIRD EMBODIMENT (UPPER ELEMENT AND LOWER ELEMENT) | FIFTH EMBODIMENT (LOWER ELEMENT AND LOOP FORMING ELEMENT) | SIXTH EMBODIMENT (UPPER ELEMENT, LOWER ELEMENT, AND LOOP FORMING ELEMENT) |
|---|---|---|---|---|---|---|
| 76 | 50.4 | 53.0 | 50.5 | 52.3 | 52.4 | 55.3 |
| 77 | 50.4 | 55.3 | 51.3 | 52.8 | 52.6 | 56.2 |
| 78 | 50.5 | 56.1 | 52.1 | 53.1 | 52.8 | 56.2 |
| 79 | 50.7 | 56.0 | 52.7 | 53.5 | 53.1 | 56.1 |
| 80 | 51.0 | 56.1 | 53.3 | 53.9 | 53.5 | 56.0 |
| 81 | 51.4 | 56.3 | 53.9 | 54.5 | 53.8 | 56.1 |
| 82 | 51.4 | 56.1 | 54.4 | 55.0 | 54.3 | 56.1 |
| 83 | 52.1 | 56.4 | 55.4 | 55.9 | 55.1 | 56.7 |
| 84 | 53.1 | 57.1 | 56.5 | 57.0 | 56.1 | 57.5 |
| 85 | 53.9 | 57.6 | 57.3 | 57.8 | 56.7 | 58.0 |
| 86 | 54.8 | 58.2 | 58.0 | 58.7 | 57.5 | 58.6 |
| 87 | 55.5 | 58.5 | 58.6 | 59.3 | 58.1 | 59.0 |
| 88 | 56.3 | 58.8 | 59.2 | 60.1 | 58.9 | 59.5 |
| 89 | 56.8 | 58.8 | 59.6 | 60.4 | 59.4 | 59.7 |
| 90 | 57.5 | 59.1 | 60.1 | 60.9 | 60.1 | 60.2 |
| 91 | 57.8 | 59.3 | 60.1 | 61.0 | 60.4 | 60.3 |
| 92 | 58.4 | 59.6 | 60.3 | 61.1 | 60.8 | 60.6 |
| 93 | 58.9 | 59.6 | 60.1 | 60.8 | 60.7 | 60.6 |
| 94 | 59.6 | 59.8 | 60.2 | 60.8 | 60.8 | 60.8 |
| 95 | 59.4 | 59.3 | 59.8 | 60.2 | 60.4 | 60.3 |
| 96 | 59.1 | 59.0 | 59.4 | 59.7 | 60.0 | 60.0 |
| 97 | 58.7 | 58.5 | 58.8 | 59.2 | 59.5 | 59.6 |
| 98 | 58.6 | 58.4 | 58.5 | 59.0 | 59.6 | 59.5 |
| 99 | 58.4 | 58.4 | 58.1 | 58.9 | 59.4 | 59.1 |
| 100 | 57.6 | 58.4 | 57.2 | 58.8 | 59.4 | 58.9 |
| 101 | 56.5 | 58.8 | 55.9 | 58.9 | 59.5 | 58.8 |
| 102 | 57.0 | 58.5 | 56.3 | 59.1 | 59.6 | 58.9 |
| 103 | 58.2 | 58.2 | 57.5 | 59.0 | 59.7 | 58.9 |
| 104 | 59.3 | 58.2 | 58.5 | 58.6 | 60.1 | 59.1 |
| 105 | 59.5 | 58.1 | 58.5 | 58.6 | 60.1 | 59.2 |
| 106 | 59.7 | 58.3 | 58.2 | 59.0 | 60.2 | 59.7 |
| 107 | 59.3 | 58.0 | 58.2 | 59.5 | 59.6 | 59.7 |
| 108 | 58.8 | 57.7 | 58.3 | 60.0 | 58.7 | 59.7 |
| AVERAGE | 56.6 | 58.0 | 57.6 | 58.5 | 58.4 | 58.8 |

As illustrated in table 1, the average gain of the horizontally polarized waves in frequency band H of the comparison example was 53.1 dBμV. Similarly, the average gain of the first embodiment was 54.1 dBμV, the average gain of the second embodiment was 53.8 dBμV, the average gain of the third embodiment was 54.6 dBμV, the average gain of the fifth embodiment was 54.7 dBμV, and the average gain of the sixth embodiment was 55.0 dBμV.

As illustrated in table 2, the average gain of the vertically polarized waves in frequency band H of the comparison example was 56.6 dBμV. Similarly, the average gain of the first embodiment was 58.0 dBμV, the average gain of the second embodiment was 57.6 dBμV, the average gain of the third embodiment was 58.5 dBμV, the average gain of the fifth embodiment was 58.4 dBμV, and the average gain of the sixth embodiment was 58.8 dBμV.

As described above, in comparison with the comparison example, according to the practical examples and the embodiments of the present invention, the gain is improved to cover the wide band by disposing at least one of the lower elements, the upper elements, and the loop forming elements and combining them.

INDUSTRIAL APPLICABILITY

The embodiment of the present invention is mainly applicable to an AM broadcast band (MW band) of 520 kHz to 1,700 kHz (520 kHz is directed to New Zealand), a long wave broadcast band (LW band) of 150 kHz to 280 kHz, a short wave broadcast band (SW band) of 2.3 MHz to 26.1 MHz, the Japanese FM broadcast band (76 MHz to 95 MHz), and the US/Europe FM broadcast band (88 MHz to 108 MHz). The embodiment of the present invention is also applicable to adjustment of a digital terrestrial television broadcast (473 MHz to 767 MHz), the US digital television broadcast (698 MHz to 806 MHz), the North America and the European television VHF band (45 MHz to 86 MHz and 175 MHz to 225 MHz) the digital radio broadcast (DAB: 170 MHz to 240 MHz and 1450 MHz to 1490 MHz), 800 MHz band for automobile telephones (810 MHz to 960 MHz), the UHF band (300 MHz to 3 GHz), the DSRC (Dedicated Short Range Communication in the 915 MHz band), the automobile keyless entry system (300 MHz to 450 MHz), and the like.

Further, the present disclosure is not limited to these embodiments, but various variations and modifications may be made without departing from the scope of the present invention.

The present application is based on and claims the benefit of priority of Japanese Priority Application No. 2015-215221 filed on Oct. 30, 2015, and Japanese Priority Application No. 2016-102841 filed on May 23, 2016 with the Japanese Patent Office, the entire contents of which are hereby incorporated by reference.

What is claimed is:

1. A glass antenna for a vehicle, the glass antenna being disposed adjacent to an upper edge portion of a window glass for the vehicle and receiving two types of frequency bands, the glass antenna comprising:

a feed point;

a first antenna conductor; and a second antenna conductor, wherein the first antenna conductor includes a vertical element for feed connection one end of which is connected to the feed point and extending upwardly from the feed point;

a first transverse element one end of which is connected to the feed point or to the vertical element for feed connection and extending substantially horizontally in a direction away from the feed point; and a second transverse element one end of which is connected to the vertical element for feed connection and extending substantially horizontally in the direction away from the feed point, the second transverse element being located above the first transverse element, wherein the second antenna conductor includes a transverse element for feed connection one end of which is connected to the feed point or to the vertical element for feed connection and extending substantially horizontally in the direction away from the feed point, a vertical element for connection one end of which is connected to the other end of the transverse element for feed connection and extending upwardly;

a third transverse element one end of which is connected to the vertical element for connection and extending substantially horizontally in a direction toward the feed point;

a fourth transverse element one end of which is connected to the vertical element for connection and extending substantially horizontally in the direction toward the feed point, the fourth transverse element being located above the third transverse element;

an upper vertical element one end of which is connected to the fourth transverse element or to the other end of the vertical element for connection and extending upwardly; and an upper transverse element one end of which is connected to the upper vertical element and extending substantially horizontally in the direction toward the feed point, wherein the first transverse element and the third transverse element are adjacent to each other and capacitively coupled to each other to form a first capacitively-coupled portion, wherein the second transverse element and the fourth transverse element are adjacent to each other and capacitively coupled to each other to form a second capacitively-coupled portion, and wherein the upper transverse element is located above the second capacitively-coupled portion.

2. The glass antenna for the vehicle according to claim 1, wherein the other end, away from the feed point, of the first transverse element is an open end, and the other end, located toward the feed point, of the third transverse element is an open end, and wherein the other end, away from the feed point, of the second transverse element is an open end, and the other end, located toward the feed point, of the fourth transverse element is an open end.

3. The glass antenna for the vehicle according to claim 1, wherein the upper transverse element is folded to extend in the direction away from the feed point after extending in the direction toward the feed point.

4. The glass antenna for the vehicle according to claim 1, wherein, when a center frequency of one of the two types of frequency bands has a wavelength of $\lambda$ in the air, glass has a shortening coefficient of wavelength of k, a formula of $\lambda g=\lambda \cdot k$ is established, and n is an integer number, a route length from the feed point to a leading end of the upper transverse element through the transverse element for feed connection, the vertical element for connection, the upper vertical element, and the upper transverse element in that order or a total length obtained by adding, to the route length, an element length to a terminal end of a folded portion of the upper transverse element is in a range from $(0.15+0.5n)\ \lambda g$ to $(0.45+0.5n)\ \lambda g$.

5. The glass antenna for the vehicle according to claim 1, wherein the second antenna conductor includes a first lower vertical element one end of which is connected to the transverse element for feed connection and extending downwardly; and a lower transverse element connected to the other end of the first lower vertical element and extending in the direction toward the feed point.

6. The glass antenna for the vehicle according to claim 5, wherein the lower transverse element is folded to extend in the direction away from the feed point after extending in the direction toward the feed point.

7. The glass antenna for the vehicle according to claim 5, wherein the second antenna conductor includes a second lower vertical element, one end of the second lower vertical element is connected to the other end of the lower transverse element and the other end of the second lower vertical element is connected to the transverse element for feed connection, and wherein the transverse element for feed connection, the first lower vertical element, the lower transverse element, and the second lower vertical element form a lower loop.

8. The glass antenna for the vehicle according to claim 5, wherein, when a center frequency of one of the two types of frequency bands has a wavelength of $\lambda$ in the air, glass has a shortening coefficient of wavelength of k, a formula of $\lambda g=\lambda \cdot k$ is established, and n is an integer number, a route length from the feed point to a leading end of the lower transverse element through the transverse element for feed connection, the first lower vertical element, and the lower transverse element in that order or a total length obtained by adding, to the route length, an element length to a terminal end of a folded portion of the lower transverse element or an element length to a terminal end of a lower loop is in a range from $0.57\ \lambda g$ to $0.62\ \lambda g$.

9. The glass antenna for the vehicle according to claim 1, further comprising at least one of a first loop forming element, connected to the transverse element for feed connection and the first transverse element, and a second loop forming element, connected to the first transverse element and the second transverse element.

10. The glass antenna for the vehicle according to claim 1, wherein the second antenna conductor includes an adjusting element one end of which is connected to the vertical element for connection and extending in the direction away from the feed point.

11. The glass antenna for the vehicle according to claim 1, wherein the glass antenna receives a frequency band from 530 kHz to 1605 kHz and a frequency band from 76 MHz to 108 MHz.

12. The glass antenna for the vehicle according to claim 1, wherein the feed point includes a first feed point and a second feed point, wherein the vertical element for feed connection is connected to the first feed point, and wherein the transverse element for feed connection is connected to the second feed point.

13. A rear window glass comprising the glass antenna for the vehicle according to claim 1.

14. The rear window glass according to claim 13, wherein the glass antenna for the vehicle receives a frequency band from 530 kHz to 1605 kHz and a frequency band from 76 MHz to 108 MHz, wherein a different type of antenna that receives a frequency band higher than the frequency band from 76 MHz to 108 MHz is disposed, and wherein the glass antenna for the vehicle adjusts receiving characteristics of the different type of antenna.

15. The rear window glass according to claim 13, wherein an auxiliary antenna that receives at least one of the two types of frequency bands is disposed on the rear window glass, and wherein the glass antenna and the auxiliary antenna performs a diversity reception in cooperation.

16. The rear window glass according to claim 13, wherein an electric heating defogger is disposed on the rear window glass, wherein the defogger includes a plurality of heater strips extending in a horizontal direction of the rear window glass, and a plurality of bus bars extending vertically at both right and left end sides of the rear window glass and configured to feed a current to the plurality of heater strips, and wherein the glass antenna for the vehicle is disposed above the defogger and a distance between the glass antenna and the defogger is 30 mm or longer.

* * * * *